US008077190B2

(12) United States Patent
Inoue et al.

(10) Patent No.: US 8,077,190 B2
(45) Date of Patent: Dec. 13, 2011

(54) EXPOSURE HEAD, AN IMAGE FORMING APPARATUS AND AN IMAGE FORMING METHOD

(75) Inventors: Nozomu Inoue, Matsumoto (JP); Yujiro Nomura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 649 days.

(21) Appl. No.: 12/260,241

(22) Filed: Oct. 29, 2008

(65) Prior Publication Data

US 2009/0116970 A1 May 7, 2009

(30) Foreign Application Priority Data

Nov. 1, 2007 (JP) ..... 2007-285192
Sep. 12, 2008 (JP) ..... 2008-234753

(51) Int. Cl.
*B41J 2/447* (2006.01)
*B41J 2/45* (2006.01)
*G03G 15/00* (2006.01)

(52) U.S. Cl. ..... 347/130; 347/238

(58) Field of Classification Search ..... 347/130, 347/237, 238, 208; 399/220
See application file for complete search history.

(56) References Cited

U.S. PATENT DOCUMENTS

| | | | | |
|---|---|---|---|---|
| 7,002,610 | B2 * | 2/2006 | Kamoshida et al. | 347/148 |
| 7,760,215 | B2 * | 7/2010 | Inoue et al. | 347/130 |
| 2009/0021571 | A1 * | 1/2009 | Inoue et al. | 347/236 |
| 2009/0103947 | A1 * | 4/2009 | Inoue et al. | 399/177 |
| 2009/0129819 | A1 * | 5/2009 | Inoue et al. | 399/220 |

FOREIGN PATENT DOCUMENTS

JP 2000-158705 A 6/2000

* cited by examiner

*Primary Examiner* — Huan Tran
(74) *Attorney, Agent, or Firm* — DLA Piper LLP (US)

(57) ABSTRACT

An exposure head, includes: imaging optical systems which are arranged in a first direction; light emitting elements which are arranged in a second direction orthogonal to or substantially orthogonal to the first direction and emit lights to be imaged by the imaging optical systems; a first wiring which is connected with the light emitting element located at a first side in the second direction; and a second wiring which is connected with the light emitting element located at a second side in the second direction.

15 Claims, 25 Drawing Sheets

EXPOSURE HEAD, AN IMAGE FORMING APPARATUS AND AN IMAGE FORMING METHOD

CROSS REFERENCE TO RELATED APPLICATION

The disclosure of Japanese Patent Applications No. 2007-285192 filed on Nov. 1, 2007 and No. 2008-234753 filed on Sep. 12, 2008 including specification, drawings and claims is incorporated herein by reference in its entirety.

BACKGROUND

1. Technical Field

The invention relates to an exposure head for imaging light beams emitted from light emitting elements by lenses and an image forming apparatus and an image forming method using the exposure head.

2. Related Art

A line head using a light emitting element array, in which a plurality of light emitting elements are linearly arrayed, is proposed as such an exposure head as disclosed, for example, in JP-A-2000-158705. In such a line head, light beams respectively emitted from the plurality of light emitting elements of the light emitting element array are imaged as spots by lenses and a plurality of spots are formed side by side in a main scanning direction.

SUMMARY

Upon forming better spot latent images, it is desirable to form the spot latent images with sufficient light quantities by increasing the size of the respective light emitting elements. However, in the above construction in which the light emitting elements are linearly arranged, it is not easy to increase the size of the light emitting elements. This is because of a possibility of producing interferences between adjacent light emitting elements in the case of making the light emitting elements larger. Even more, as in the case where a pitch between light emitting elements is made smaller for higher resolution, it is even more difficult to increase the size of the light emitting elements.

What should be considered upon enlarging the light emitting elements is not only the above arrangement mode of the light emitting elements, but also wirings connected with the light emitting elements. This is because it becomes difficult to enlarge the light emitting elements when many wirings are arranged between the light emitting elements.

An advantage of some aspects of the invention is to provide technology enabling the formation of a latent image with a sufficient light quantity even at a high resolution.

According to a first aspect of the invention, there is provided an exposure head, comprising: imaging optical systems which are arranged in a first direction; light emitting elements which are arranged in a second direction orthogonal to or substantially orthogonal to the first direction and emit lights to be imaged by the imaging optical systems; a first wiring which is connected with the light emitting element located at a first side in the second direction; and a second wiring which is connected with the light emitting element located at a second side in the second direction.

According to a second aspect of the invention, there is provided an image forming apparatus, comprising: an exposure head which includes imaging optical systems which are arranged in a first direction, light emitting elements which are arranged in a second direction orthogonal to or substantially orthogonal to the first direction and emit lights to be imaged by the imaging optical systems, a first wiring which is connected with the light emitting element located at a first side in the second direction, and a second wiring which is connected with the light emitting element located at a second side in the second direction; and a latent image carrier which carries a latent image formed by the exposure head.

According to a third aspect of the invention, there is provided an image forming method, comprising: forming a latent image on a latent image carrier by an exposure head which includes imaging optical systems which are arranged in a first direction, light emitting elements which are arranged in a second direction orthogonal to or substantially orthogonal to the first direction and emit lights to be imaged by the imaging optical systems, a first wiring which is connected with the light emitting element located at a first side in the second direction, and a second wiring which is connected with the light emitting element located at a second side in the second direction.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DESCRIPTION OF EXEMPLARY EMBODIMENTS

A. Description of Terms

Terms used in this specification are described before the description of embodiments of the invention.

Figure 1:
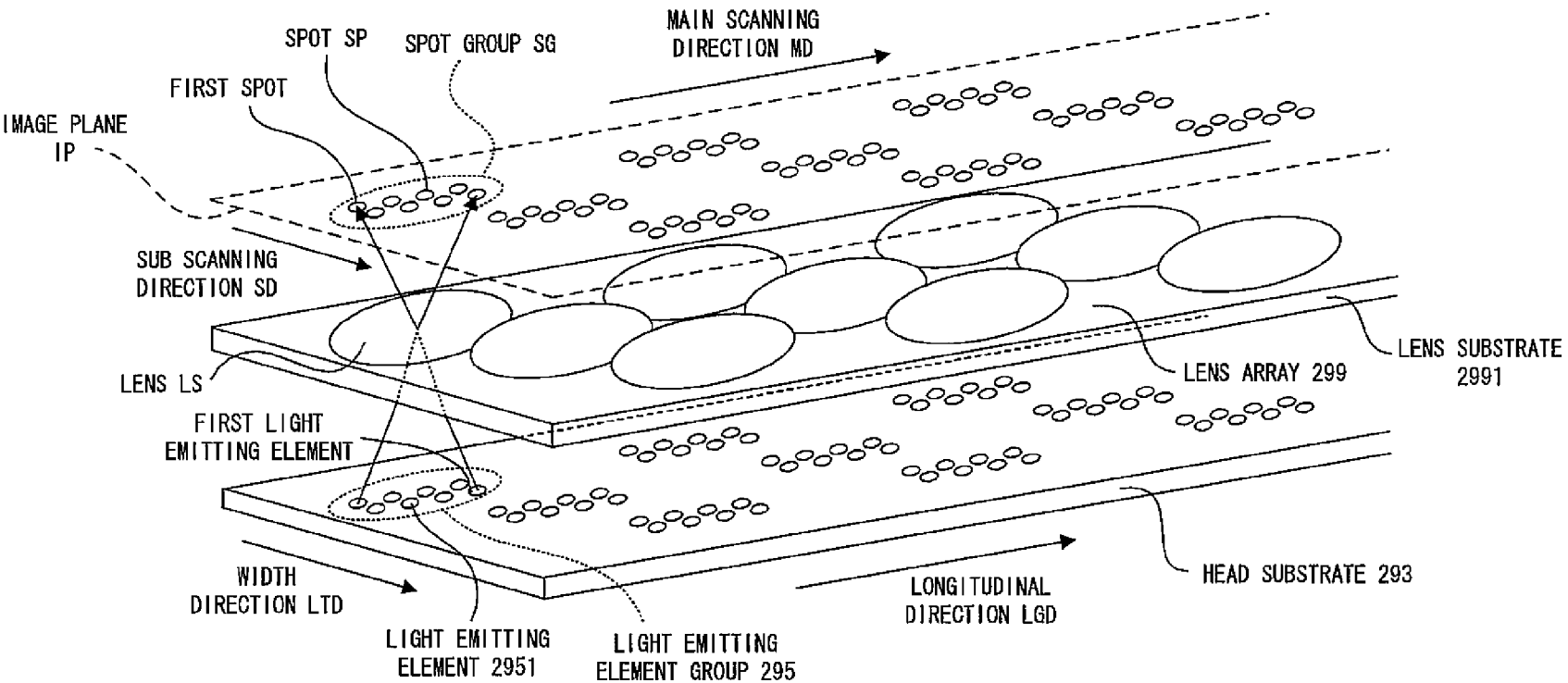
FIGS. 1 and 2 are diagrams showing terminology used in this specification.
Figure 2:
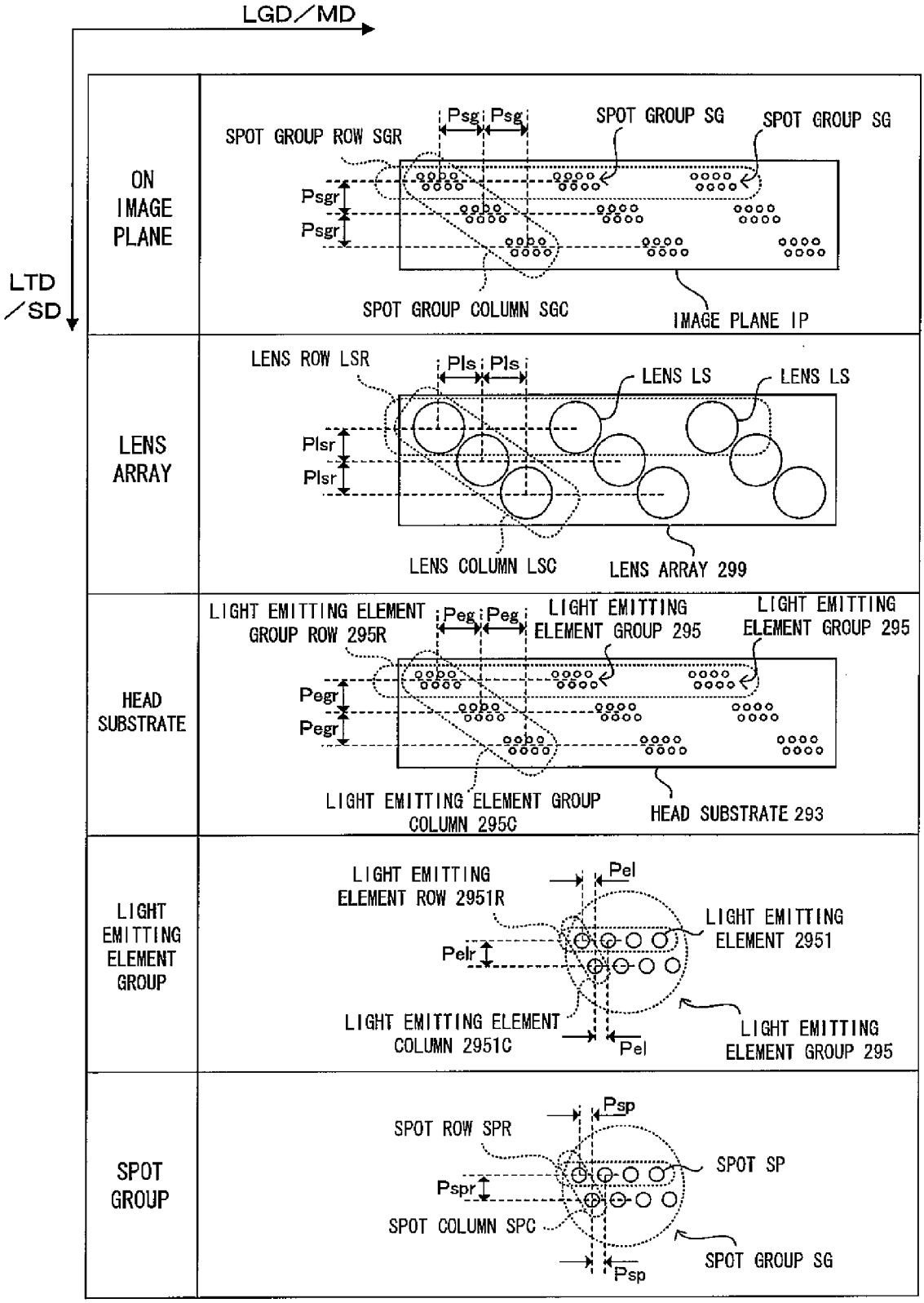

FIGS. 1 and 2 are diagrams showing terminology used in this specification. Here, terminology used in this specification is organized with reference to FIGS. 1 and 2. In this specification, a conveying direction of a surface (image plane IP) of a photosensitive drum 21 is defined to be a sub scanning direction SD and a direction orthogonal to or substantially orthogonal to the sub scanning direction SD is defined to be a main scanning direction MD. Further, a line head 29 is arranged relative to the surface (image plane IP) of the photosensitive drum 21 such that its longitudinal direction LGD corresponds to the main scanning direction MD and its width direction LTD corresponds to the sub scanning direction SD.

Collections of a plurality of (eight in FIGS. 1 and 2) light emitting elements 2951 arranged on a head substrate 293 in one-to-one correspondence with a plurality of lenses LS of a lens array 299 are defined to be light emitting element groups 295. In other words, in the head substrate 293, the plurality of light emitting element groups 295 including the plurality of light emitting elements 2951 are arranged in conformity with the plurality of lenses LS, respectively. Further, collections of a plurality of spots SP formed on the image plane IP by imaging light beams from the light emitting element groups 295 toward the image plane IP by the lenses LS corresponding to the light emitting element groups 295 are defined to be spot groups SG. In other words, a plurality of spot groups SG can be formed in one-to-one correspondence with the plurality of light emitting element groups 295. In each spot group SG, the most upstream spot in the main scanning direction MD and the sub scanning direction SD is particularly defined to be a first spot. The light emitting element 2951 corresponding to the first spot is particularly defined to be a first light emitting element.

A spot group row SGR and a spot group column SGC are defined as shown in the column "On Image Plane" of FIG. 2. Specifically, a plurality of spot groups SG arranged in the main scanning direction MD are defined as the spot group row SGR. A plurality of spot group rows SGR are arranged at specified spot group row pitches Psgr in the sub scanning direction SD. Further, a plurality of (three in FIG. 2) spot groups SG arranged at spot group row pitches Psgr in the sub scanning direction SD and at spot group pitches Psg in the main scanning direction MD are defined as the spot group column SGC. It should be noted that the spot group row pitch Psgr is a distance in the sub scanning direction SD between the geometric centers of gravity of two spot group rows SGR adjacent in the sub scanning direction SD, and that the spot group pitch Psg is a distance in the main scanning direction MD between the geometric centers of gravity of two spot groups SG adjacent in the main scanning direction MD.

Lens rows LSR and lens columns LSC are defined as shown in the column of "Lens Array" of FIG. 2. Specifically, a plurality of lenses LS aligned in the longitudinal direction LGD is defined to be the lens row LSR. A plurality of lens rows LSR are arranged at specified lens row pitches Plsr in the width direction LTD. Further, a plurality of (three in FIG. 2) lenses LS arranged at the lens row pitches Plsr in the width direction LTD and at lens pitches Pls in the longitudinal direction LGD are defined to be the lens column LSC. It should be noted that the lens row pitch Plsr is a distance in the width direction LTD between the geometric centers of gravity of two lens rows LSR adjacent in the width direction LTD, and that the lens pitch Pls is a distance in the longitudinal direction LGD between the geometric centers of gravity of two lenses LS adjacent in the longitudinal direction LGD.

Light emitting element group rows 295R and light emitting element group columns 295C are defined as shown in the column "Head Substrate" of FIG. 2. Specifically, a plurality of light emitting element groups 295 aligned in the longitudinal direction LGD is defined to be the light emitting element group row 295R. A plurality of light emitting element group rows 295R are arranged at specified light emitting element group row pitches Pegr in the width direction LTD. Further, a plurality of (three in FIG. 2) light emitting element groups 295 arranged at the light emitting element group row pitches Pegr in the width direction LTD and at light emitting element group pitches Peg in the longitudinal direction LGD are defined to be the light emitting element group column 295C. It should be noted that the light emitting element group row pitch Pegr is a distance in the width direction LTD between the geometric centers of gravity of two light emitting element group rows 295R adjacent in the width direction LTD, and that the light emitting element group pitch Peg is a distance in the longitudinal direction LGD between the geometric centers of gravity of two light emitting element groups 295 adjacent in the longitudinal direction LGD.

Light emitting element rows 2951R and light emitting element columns 2951C are defined as shown in the column "Light Emitting Element Group" of FIG. 2. Specifically, in each light emitting element group 295, a plurality of light emitting elements 2951 aligned in the longitudinal direction LGD is defined to be the light emitting element row 2951R. A plurality of light emitting element rows 2951R are arranged at specified light emitting element row pitches Pelr in the width direction LTD. Further, a plurality of (two in FIG. 2) light emitting elements 2951 arranged at the light emitting element row pitches Pelr in the width direction LTD and at light emitting element pitches Pel in the longitudinal direction LGD are defined to be the light emitting element column 2951C. It should be noted that the light emitting element row pitch Pelr is a distance in the width direction LTD between the geometric centers of gravity of two light emitting element rows 2951R adjacent in the width direction LTD, and that the light emitting element pitch Pel is a distance in the longitudinal direction LGD between the geometric centers of gravity of two light emitting elements 2951 adjacent in the longitudinal direction LGD.

Spot rows SPR and spot columns SPC are defined as shown in the column "Spot Group" of FIG. 2. Specifically, in each spot group SG, a plurality of spots SP aligned in the longitudinal direction LGD is defined to be the spot row SPR. A plurality of spot rows SPR are arranged at specified spot row pitches Pspr in the width direction LTD. Further, a plurality of (two in FIG. 2) spots SP arranged at the spot row pitches Pspr in the width direction LTD and at spot pitches Psp in the longitudinal direction LGD are defined to be the spot column SPC. It should be noted that the spot row pitch Pspr is a distance in the sub scanning direction SD between the geometric centers of gravity of two spot rows SPR adjacent in the sub scanning direction SD, and that the spot pitch Psp is a distance in the main scanning direction MD between the geometric centers of gravity of two spots SP adjacent in the main scanning direction MD.

B. Embodiment

Figure 3:
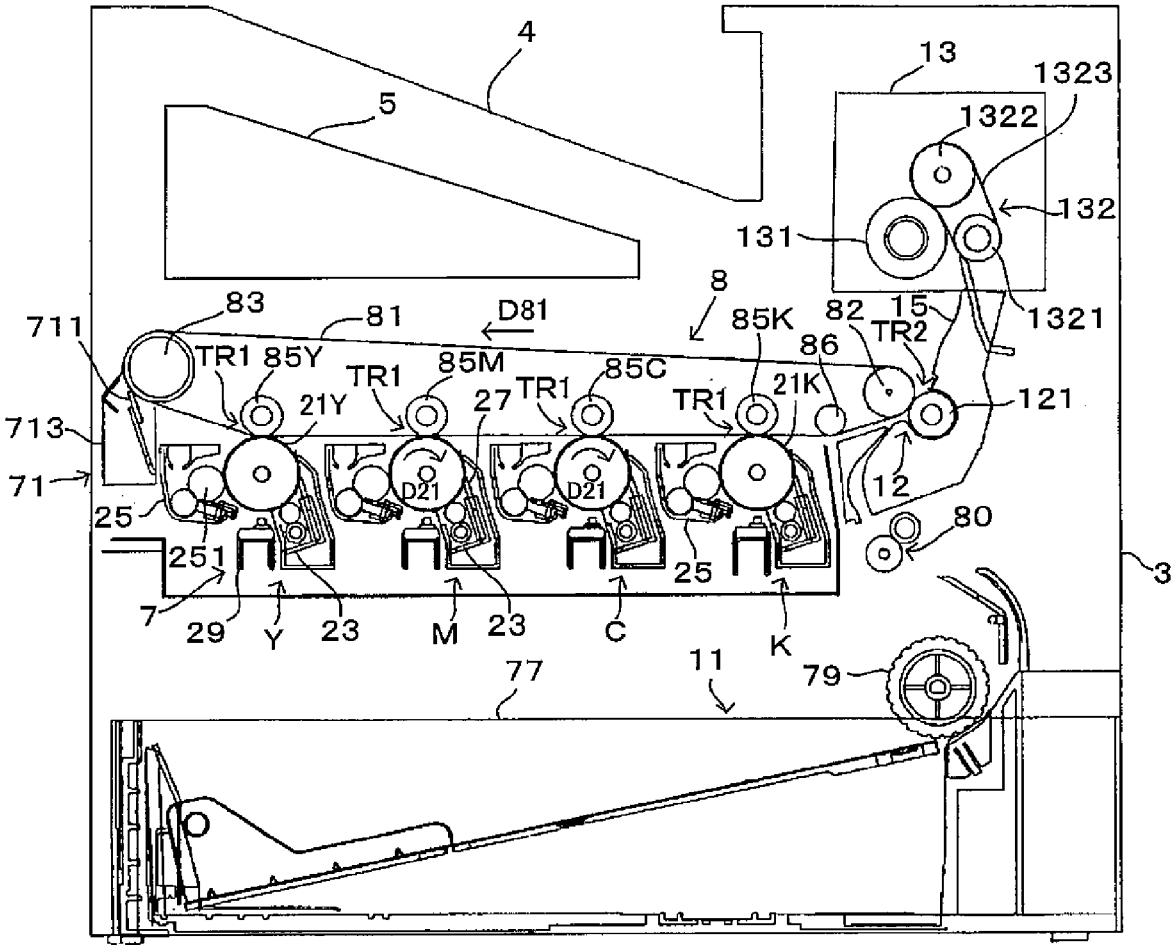
FIG. 3 is a diagram showing an embodiment of an image forming apparatus to which the invention is applicable.
Figure 4:
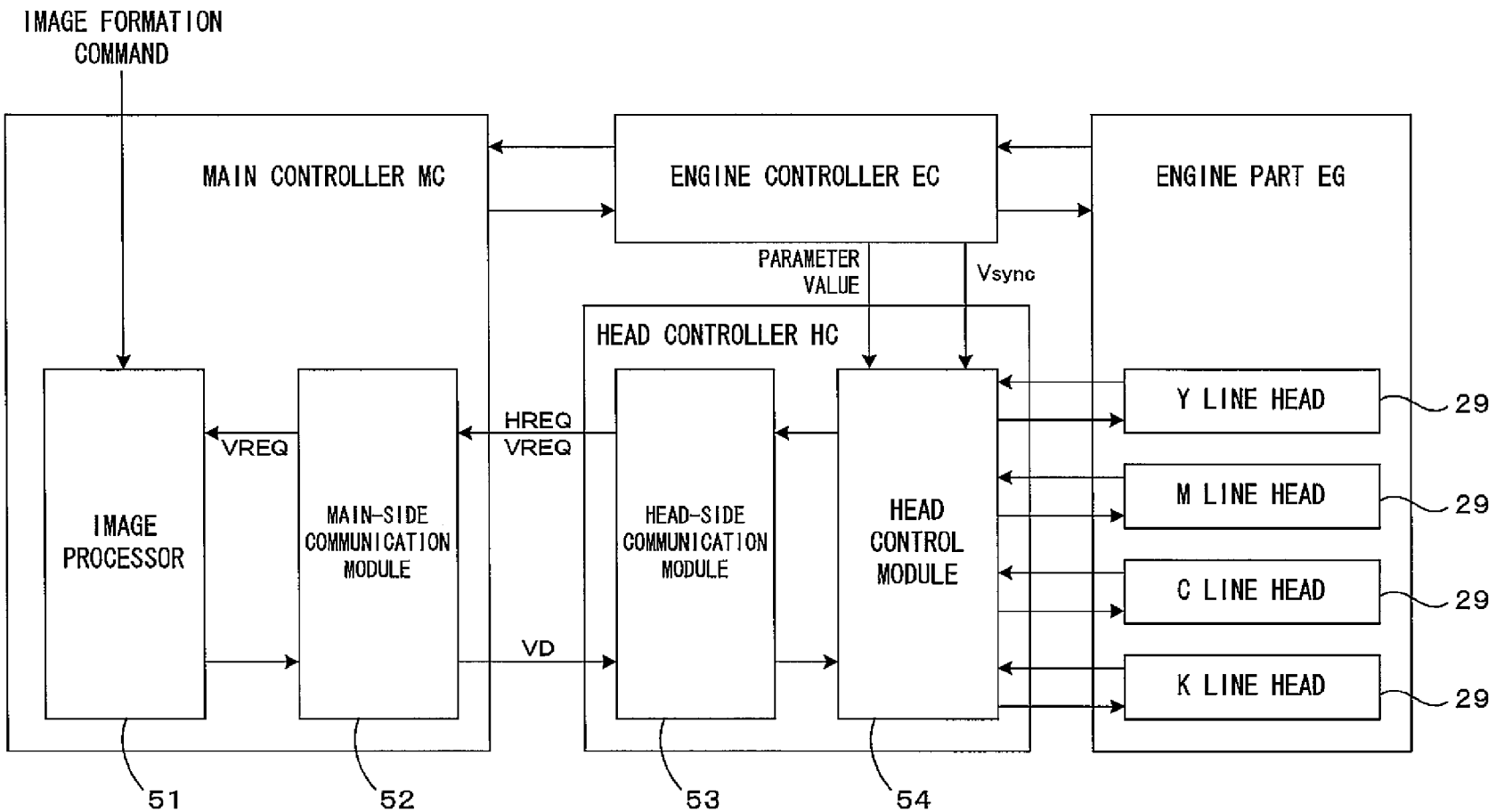
FIG. 4 is a diagram showing the electrical construction of the image forming apparatus of FIG. 3.

FIG. 3 is a diagram showing an embodiment of an image forming apparatus to which the invention is applicable. FIG. 4 is a diagram showing the electrical construction of the image forming apparatus of FIG. 3. This apparatus is an image forming apparatus that can selectively execute a color mode for forming a color image by superimposing four color toners of black (K), cyan (C), magenta (M) and yellow (Y) and a monochromatic mode for forming a monochromatic image using only black (K) toner. FIG. 3 is a diagram corresponding to the execution of the color mode. In this image forming apparatus, when an image formation command is given from an external apparatus such as a host computer to a main controller MC having a CPU and memories, the main controller MC feeds a control signal and the like to an engine controller EC and feeds video data VD corresponding to the image formation command to a head controller HC. This head controller HC controls line heads 29 of the respective colors based on the video data VD from the main controller MC, a vertical synchronization signal Vsync from the engine controller EC and parameter values from the engine controller EC. In this way, an engine part EG performs a specified image forming operation to form an image corresponding to the image formation command on a sheet such as a copy sheet, transfer sheet, form sheet or transparent sheet for OHP.

An electrical component box 5 having a power supply circuit board, the main controller MC, the engine controller EC and the head controller HC built therein is disposed in a housing main body 3 of the image forming apparatus. An image forming unit 7, a transfer belt unit 8 and a sheet feeding unit 11 are also arranged in the housing main body 3. A secondary transfer unit 12, a fixing unit 13 and a sheet guiding member 15 are arranged at the right side in the housing main body 3 in FIG. 3. It should be noted that the sheet feeding unit 11 is detachably mountable into the housing main body 3. The sheet feeding unit 11 and the transfer belt unit 8 are so constructed as to be detachable for repair or exchange respectively.

The image forming unit 7 includes four image forming stations Y (for yellow), M (for magenta), C (for cyan) and K (for black) which form a plurality of images having different colors. Each of the image forming stations Y, M, C and K includes a cylindrical photosensitive drum 21 having a surface of a specified length in a main scanning direction MD. Each of the image forming stations Y, M, C and K forms a toner image of the corresponding color on the surface of the photosensitive drum 21. The photosensitive drum is arranged so that the axial direction thereof is substantially parallel to the main scanning direction MD. Each photosensitive drum 21 is connected to its own driving motor and is driven to rotate at a specified speed in a direction of arrow D21 in FIG. 3, whereby the surface of the photosensitive drum 21 is transported in a sub scanning direction SD which is orthogonal to or substantially orthogonal to the main scanning direction MD. Further, a charger 23, the line head 29, a developer 25 and a photosensitive drum cleaner 27 are arranged in a rotating direction around each photosensitive drum 21. A charging operation, a latent image forming operation and a toner developing operation are performed by these functional sections. Accordingly, a color image is formed by superimposing toner images formed by all the image forming stations Y, M, C and K on a transfer belt 81 of the transfer belt unit 8 at the time of executing the color mode, and a monochromatic image is formed using only a toner image formed by the image forming station K at the time of executing the monochromatic mode. Meanwhile, since the respective image forming stations of the image forming unit 7 are identically constructed, reference characters are given to only some of the image forming stations while being not given to the other image forming stations in order to facilitate the diagrammatic representation in FIG. 3.

The charger 23 includes a charging roller having the surface thereof made of an elastic rubber. This charging roller is constructed to be rotated by being held in contact with the surface of the photosensitive drum 21 at a charging position. As the photosensitive drum 21 rotates, the charging roller is rotated at the same circumferential speed in a direction driven by the photosensitive drum 21. This charging roller is connected to a charging bias generator (not shown) and charges the surface of the photosensitive drum 21 at the charging position where the charger 23 and the photosensitive drum 21 are in contact upon receiving the supply of a charging bias from the charging bias generator.

The line head 29 is arranged relative to the photosensitive drum 21 so that the longitudinal direction thereof corresponds to the main scanning direction MD and the width direction thereof corresponds to the sub scanning direction SD. Hence, the longitudinal direction of the line head 29 is substantially parallel to the main scanning direction MD. The line head 29 includes a plurality of light emitting elements arrayed in the longitudinal direction and is positioned separated from the photosensitive drum 21. Light beams are emitted from these light emitting elements toward the surface of the photosensitive drum 21 charged by the charger 23, thereby forming an electrostatic latent image on this surface.

The developer 25 includes a developing roller 251 carrying toner on the surface thereof. By a development bias applied to the developing roller 251 from a development bias generator (not shown) electrically connected to the developing roller 251, charged toner is transferred from the developing roller 251 to the photosensitive drum 21 to develop the latent image formed by the line head 29 at a development position where the developing roller 251 and the photosensitive drum 21 are in contact.

The toner image developed at the development position in this way is primarily transferred to the transfer belt 81 at a primary transfer position TR1 to be described later where the transfer belt 81 and each photosensitive drum 21 are in contact after being transported in the rotating direction D21 of the photosensitive drum 21.

Further, the photosensitive drum cleaner 27 is disposed in contact with the surface of the photosensitive drum 21 downstream of the primary transfer position TR1 and upstream of the charger 23 with respect to the rotating direction D21 of the photosensitive drum 21. This photosensitive drum cleaner 27 removes the toner remaining on the surface of the photosensitive drum 21 to clean after the primary transfer by being held in contact with the surface of the photosensitive drum.

The transfer belt unit 8 includes a driving roller 82, a driven roller (blade facing roller) 83 arranged to the left of the driving roller 82 in FIG. 3, and the transfer belt 81 mounted on these rollers. The transfer belt unit 8 also includes four primary transfer rollers 85Y, 85M, 85C and 85K arranged to face in a one-to-one relationship with the photosensitive drums 21 of the respective image forming stations Y, M, C and K inside the transfer belt 81 when the photosensitive cartridges are mounted. These primary transfer rollers 85Y, 85M, 85C and 85K are respectively electrically connected to a primary transfer bias generator (not shown). As described in detail later, at the time of executing the color mode, all the primary transfer rollers 85Y, 85M, 85C and 85K are positioned on the sides of the image forming stations Y, M, C and K as shown in FIG. 3, whereby the transfer belt 81 is pressed into contact with the photosensitive drums 21 of the image forming stations Y, M, C and K to form the primary transfer positions TR1 between the respective photosensitive drums 21 and the transfer belt 81. By applying primary transfer biases from the primary transfer bias generator to the primary transfer rollers 85Y, 85M, 85C and 85K at suitable timings, the toner images formed on the surfaces of the respective photosensitive drums 21 are transferred to the surface of the transfer belt 81 at the corresponding primary transfer positions TR1 to form a color image.

On the other hand, out of the four primary transfer rollers 85Y, 85M, 85C and 85K, the color primary transfer rollers 85Y, 85M, 85C are separated from the facing image forming stations Y, M and C and only the monochromatic primary transfer roller 85K is brought into contact with the image forming station K at the time of executing the monochromatic mode, whereby only the monochromatic image forming station K is brought into contact with the transfer belt 81. As a result, the primary transfer position TR1 is formed only between the monochromatic primary transfer roller 85K and the image forming station K. By applying a primary transfer bias at a suitable timing from the primary transfer bias generator to the monochromatic primary transfer roller 85K, the toner image formed on the surface of the photosensitive drum 21 is transferred to the surface of the transfer belt 81 at the primary transfer position TR1 to form a monochromatic image.

The transfer belt unit 8 further includes a downstream guide roller 86 disposed downstream of the monochromatic primary transfer roller 85K and upstream of the driving roller 82. This downstream guide roller 86 is so disposed as to come into contact with the transfer belt 81 on an internal common tangent to the primary transfer roller 85K and the photosensitive drum 21 at the primary transfer position TR1 formed by the contact of the monochromatic primary transfer roller 85K with the photosensitive drum 21 of the image forming station K.

The driving roller 82 drives to rotate the transfer belt 81 in the direction of the arrow D81 and doubles as a backup roller for a secondary transfer roller 121. A rubber layer having a thickness of about 3 mm and a volume resistivity of 1000 kΩ·cm or lower is formed on the circumferential surface of the driving roller 82 and is grounded via a metal shaft, thereby serving as an electrical conductive path for a secondary transfer bias to be supplied from an unillustrated secondary transfer bias generator via the secondary transfer roller 121. By providing the driving roller 82 with the rubber layer having high friction and shock absorption, an impact caused upon the entrance of a sheet into a contact part (secondary transfer position TR2) of the driving roller 82 and the secondary transfer roller 121 is unlikely to be transmitted to the transfer belt 81 and image deterioration can be prevented.

The sheet feeding unit 11 includes a sheet feeding section which has a sheet cassette 77 capable of holding a stack of sheets, and a pickup roller 79 which feeds the sheets one by one from the sheet cassette 77. The sheet fed from the sheet feeding section by the pickup roller 79 is fed to the secondary transfer position TR2 along the sheet guiding member 15 after having a sheet feed timing adjusted by a pair of registration rollers 80.

The secondary transfer roller 121 is provided freely to abut on and move away from the transfer belt 81, and is driven to abut on and move away from the transfer belt 81 by a secondary transfer roller driving mechanism (not shown). The fixing unit 13 includes a heating roller 131 which is freely rotatable and has a heating element such as a halogen heater built therein, and a pressing section 132 which presses this heating roller 131. The sheet having an image secondarily transferred to the front side thereof is guided by the sheet guiding member 15 to a nip portion formed between the heating roller 131 and a pressure belt 1323 of the pressing section 132, and the image is thermally fixed at a specified temperature in this nip portion. The pressing section 132 includes two rollers 1321 and 1322 and the pressure belt 1323 mounted on these rollers. Out of the surface of the pressure belt 1323, a part stretched by the two rollers 1321 and 1322 is pressed against the circumferential surface of the heating roller 131, thereby forming a sufficiently wide nip portion between the heating roller 131 and the pressure belt 1323. The sheet having been subjected to the image fixing operation in this way is transported to the discharge tray 4 provided on the upper surface of the housing main body 3.

Further, a cleaner 71 is disposed facing the blade facing roller 83 in this apparatus. The cleaner 71 includes a cleaner blade 711 and a waste toner box 713. The cleaner blade 711 removes foreign matters such as toner remaining on the transfer belt after the secondary transfer and paper powder by holding the leading end thereof in contact with the blade facing roller 83 via the transfer belt 81. Foreign matters thus removed are collected into the waste toner box 713. Further, the cleaner blade 711 and the waste toner box 713 are constructed integral to the blade facing roller 83. Accordingly, if the blade facing roller 83 moves as described next, the cleaner blade 711 and the waste toner box 713 move together with the blade facing roller 83.

Figure 5:
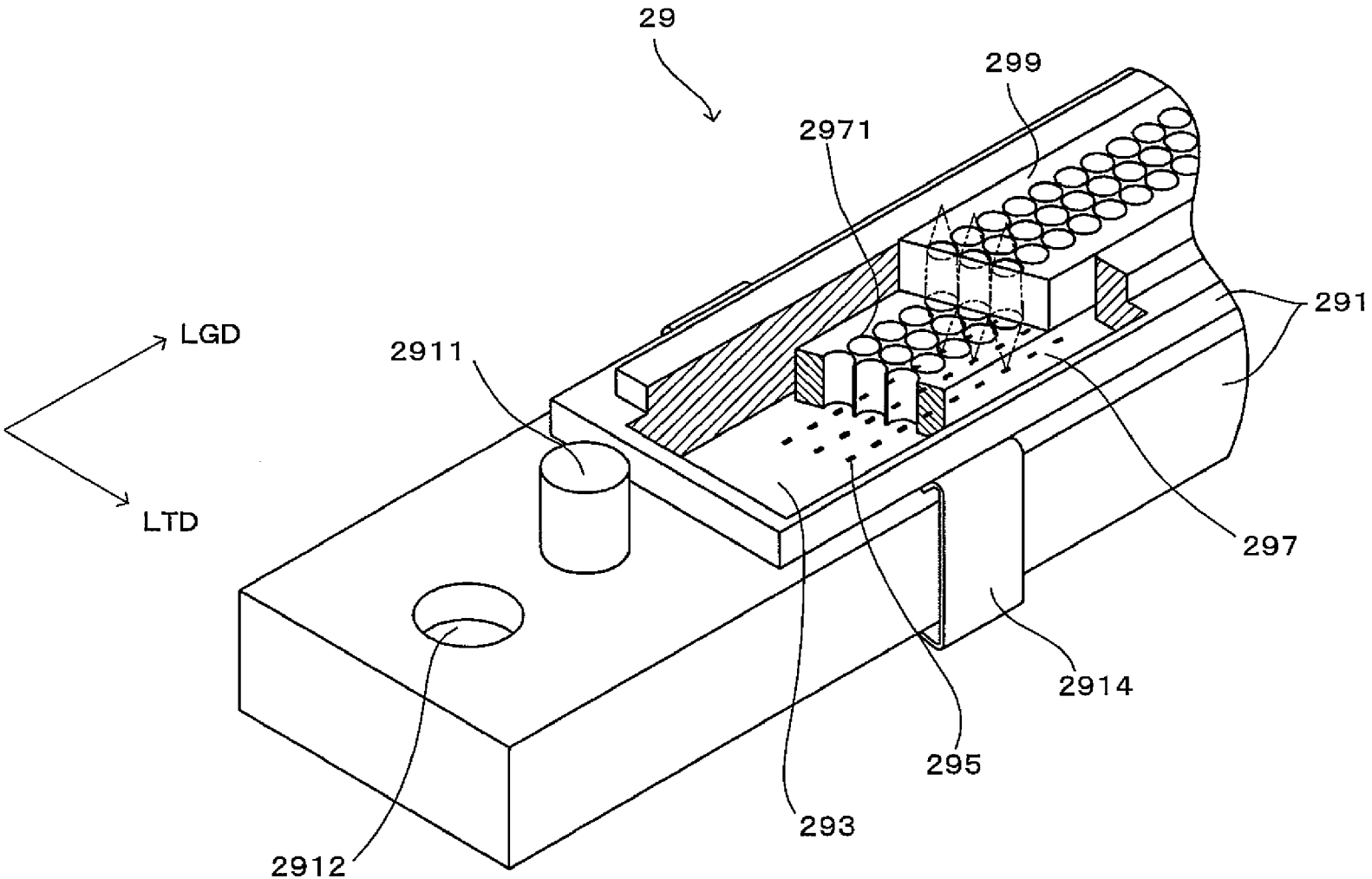
FIG. 5 is a perspective view schematically showing a line head.
Figure 6:
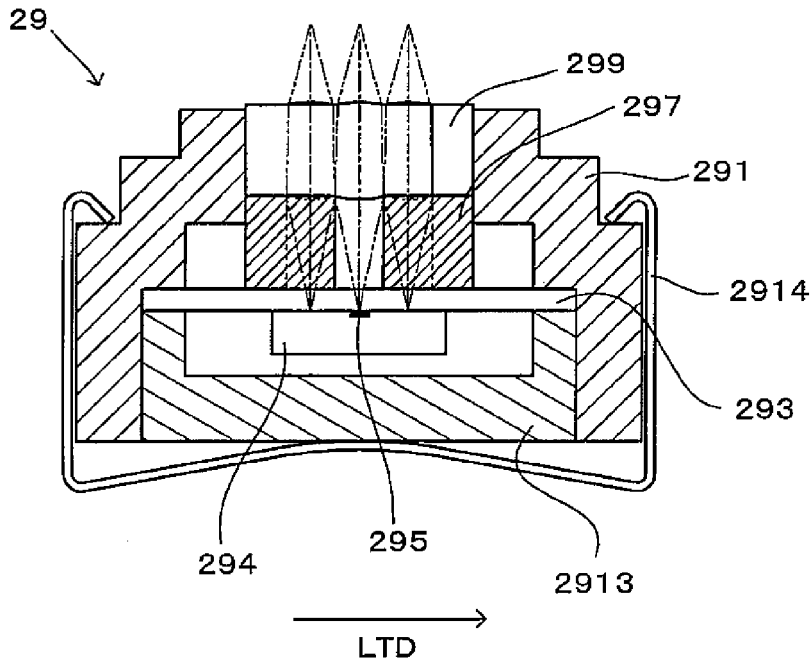
FIG. 6 is a sectional view along a width direction of the line head shown in FIG. 5.

FIG. 5 is a perspective view schematically showing a line head, and FIG. 6 is a sectional view along a width direction of the line head shown in FIG. 5. As described above, the line head 29 is arranged to face the photosensitive drum 21 such that the longitudinal direction LGD corresponds to the main scanning direction MD and the width direction LTD corresponds to the sub scanning direction SD. The longitudinal direction LGD and the width direction LTD are normal to or substantially normal to each other. Further, the longitudinal direction LGD is parallel to or substantially parallel to the main scanning direction MD and the width direction LTD is parallel to or substantially parallel to the sub scanning direction SD. The line head 29 of this embodiment includes a case 291, and a positioning pin 2911 and a screw insertion hole 2912 are provided at each of the opposite ends of such a case 291 in the longitudinal direction LGD. The line head 29 is positioned relative to the photosensitive drum 21 by fitting such positioning pins 2911 into positioning holes (not shown) perforated in a photosensitive drum cover (not shown) covering the photosensitive drum 21 and positioned relative to the photosensitive drum 21. Further, the line head 29 is positioned and fixed relative to the photosensitive drum 21 by screwing fixing screws into screw holes (not shown) of the photosensitive drum cover via the screw insertion holes 2912 to be fixed.

The case 291 carries a lens array 299 at a position facing the surface of the photosensitive drum 21, and includes a light shielding member 297 and a head substrate 293 inside, the light shielding member 297 being closer to the lens array 299 than the head substrate 293. The head substrate 293 is made of a transmissive material (glass for instance). Further, a plurality of bottom emission-type EL (electroluminescence)

devices are provided on an under surface of the head substrate 293 (surface opposite to the lens array 299 out of two surfaces of the head substrate 293) as the plurality of light emitting elements 2951. The plurality of light emitting elements 2951 are arranged as groups for each light emitting element group 295 as described later. The light beams emitted from the respective light emitting element groups 295 propagate toward the light shielding member 297 after passing through the head substrate 293 from the under surface thereof to a top surface thereof.

The light shielding member 297 is perforated with a plurality of light guide holes 2971 in a one-to-one correspondence with the plurality of light emitting element groups 295. The light guide holes 2971 are substantially cylindrical holes penetrating the light shielding member 297 and having central axes in parallel with normals to the head substrate 293. Accordingly, out of light beams emitted from the light emitting element groups 295, those propagating toward other than the light guide holes 2971 corresponding to the light emitting element groups 295 are shielded by the light shielding member 297. In this way, all the lights emitted from one light emitting element group 295 propagate toward the lens array 299 via the same light guide hole 2971 and the mutual interference of the light beams emitted from different light emitting element groups 295 can be prevented by the light shielding member 297. The light beams having passed through the light guide holes 2971 perforated in the light shielding member 297 are imaged as spots on the surface of the photosensitive drum 21 by the lens array 299.

As shown in FIG. 6, an underside lid 2913 is pressed against the case 291 via the head substrate 293 by retainers 2914. Specifically, the retainers 2914 have elastic forces to press the underside lid 2913 toward the case 291, and seal the inside of the case 291 light-tight (that is, so that light does not leak from the inside of the case 291 and so that light does not intrude into the case 291 from the outside) by pressing the underside lid by means of the elastic force. It should be noted that a plurality of the retainers 2914 are provided at a plurality of positions in the longitudinal direction of the case 291. The light emitting element groups 295 are covered with a sealing member 294.

Figure 7:
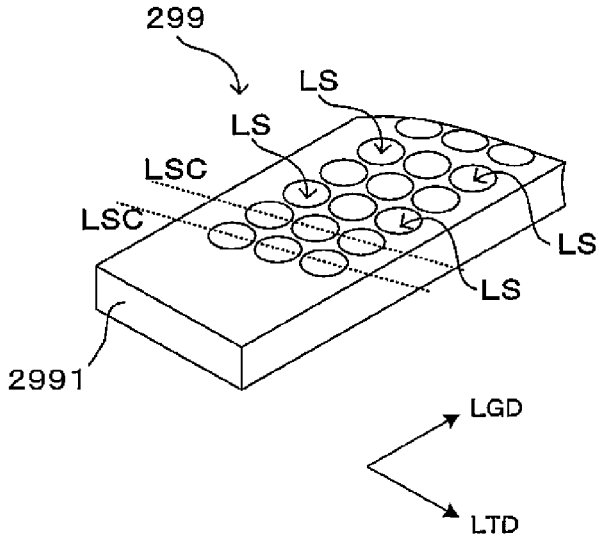
FIG. 7 is a schematic partial perspective view of the lens array.
Figure 8:
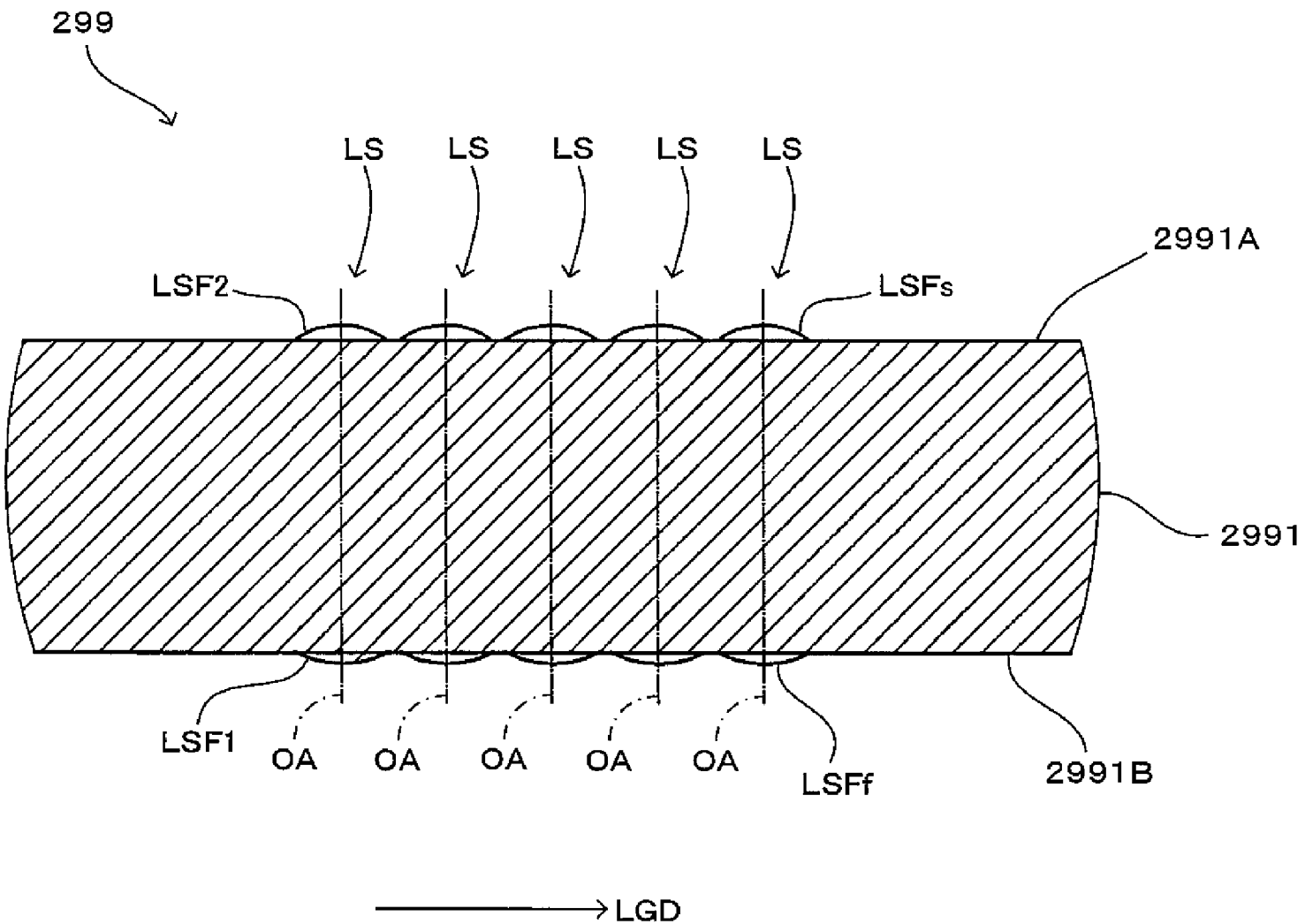
FIG. 8 is a sectional view of the lens array in the longitudinal direction LGD.

FIG. 7 is a schematic partial perspective view of the lens array, and FIG. 8 is a sectional view of the lens array in the longitudinal direction LGD. The lens array 299 includes a lens substrate 2991. First surfaces LSFf of the lenses LS are formed on an under surface 2991B of the lens substrate 2991, and second surfaces LSFs of the lenses LS are formed on a top surface 2991A of the lens substrate 2991. The first and second surfaces LSFf, LSFs facing each other and the lens substrate 2991 held between these two surfaces function as one lens LS. The first and second surfaces LSFf, LSFs of the lenses LS can be made of resin for instance.

The lens array 299 is arranged such that optical axes OA of a plurality of lenses LS are substantially parallel to each other. The lens array 299 is also arranged such that the optical axes OA of the lenses LS are substantially orthogonal to an under surface (surface where the light emitting elements 2951 are arranged) of the head substrate 293. The lenses LS are provided in a one-to-one correspondence with the light emitting element groups 295, and a plurality of lenses LS are two-dimensionally arranged in conformity with the arrangement of the light emitting element groups 295 to be described later. In other words, a plurality of lens columns LSC each including three lenses LS arranged at mutually different positions in the width direction LTD are arranged in the longitudinal direction LGD.

Figure 9:
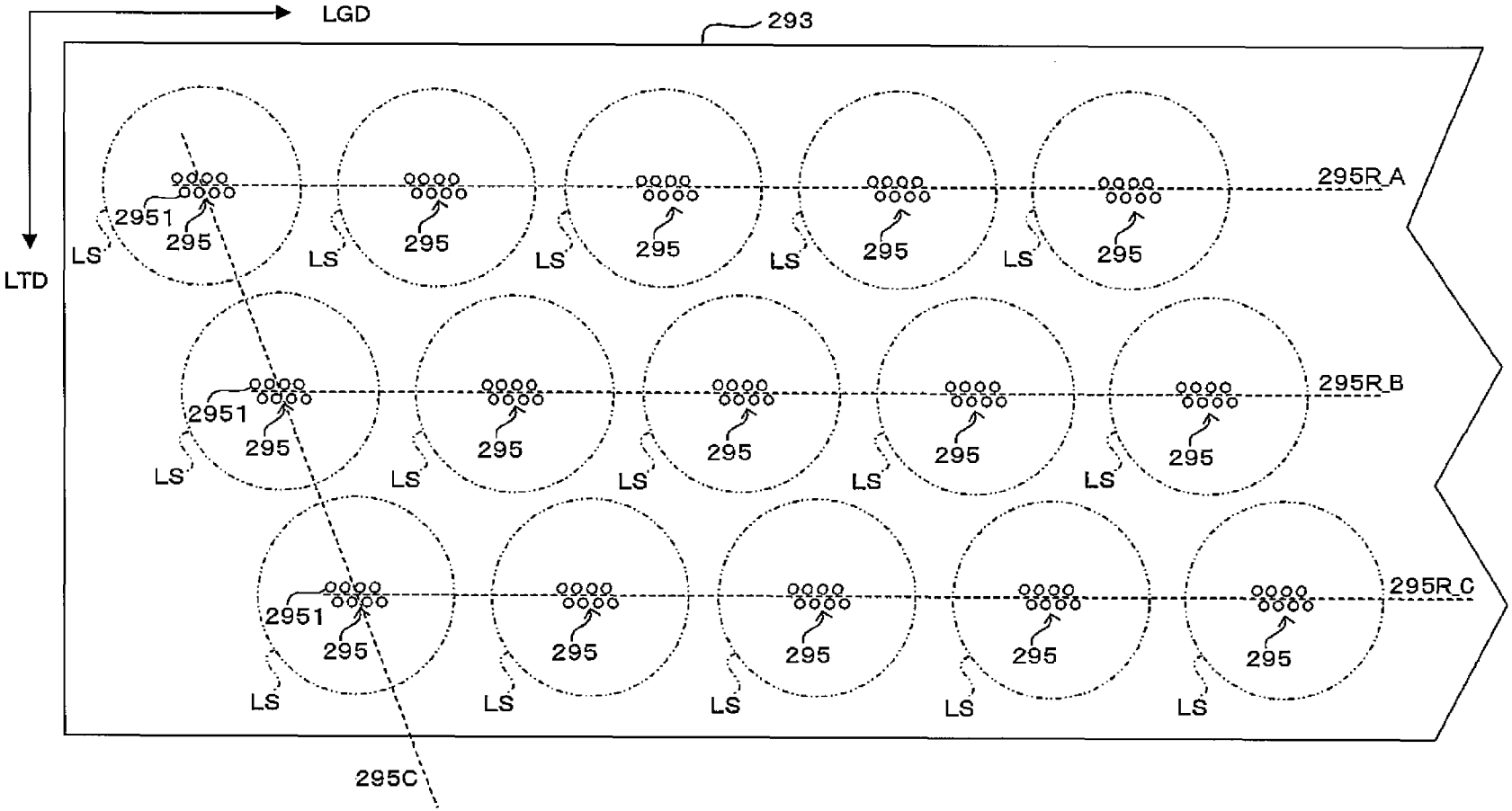
FIG. 9 is a diagram showing the construction of the under surface of the head substrate.

FIG. 9 is a diagram showing the construction of the under surface of the head substrate and corresponds to a case where the under surface of the head substrate is seen from the top surface. In FIG. 9, the lenses LS are shown by chain double-dashed line to show that the light emitting element groups 295 are provided in a one-to-one correspondence with the lenses LS, but not to show that the lenses LS are arranged on the under surface of the head substrate. As shown in FIG. 9, the plurality of light emitting element group columns 295C each including three light emitting element groups 295 arranged at mutually different positions in the width direction LTD are arranged in the longitudinal direction LGD. In other words, three light emitting element group rows 295R each including a plurality of light emitting element groups 295 arranged in the longitudinal direction LGD are arranged in the width direction LTD. At this time, the respective light emitting element group rows 295R are displaced from each other in the longitudinal direction LGD so that the positions of the respective light emitting element groups 295 are different from each other in the longitudinal direction LGD. Here, the three light emitting element group rows are identified by 295R_A, 295R_B and 295R_C in this order from the upstream side in the width direction LGD.

Figure 10:
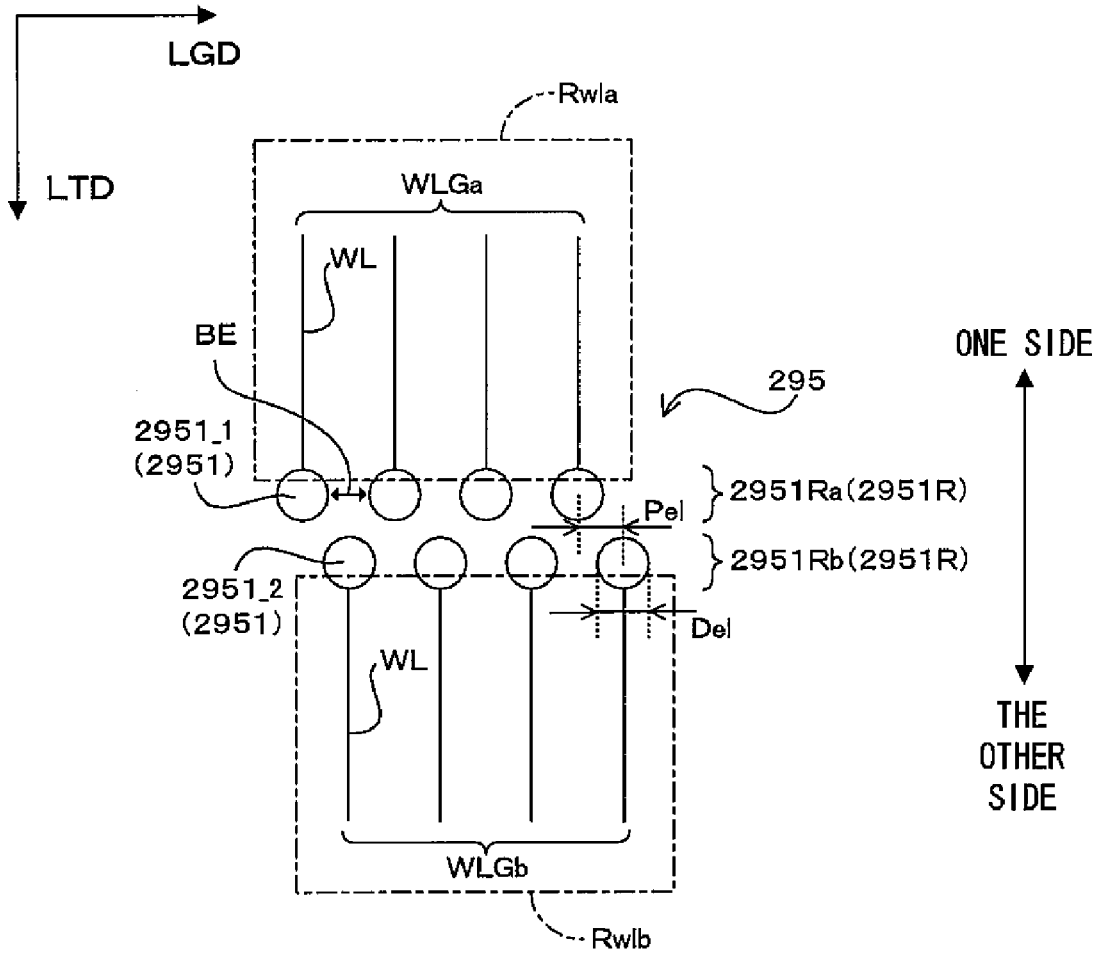
FIG. 10 is a diagram showing the configuration of the light emitting element group.

FIG. 10 is a diagram showing the configuration of the light emitting element group. As shown in FIG. 10, an even number of light emitting element rows 2951R (two rows in FIG. 10) each including four light emitting elements 2951 aligned in the longitudinal direction are arranged in the width direction LTD. The respective light emitting element rows 2951Ra, 2951Rb are displaced by the light emitting element pitch Pel in the width direction LTD, and the respective light emitting elements 2951 are located at positions different in the width direction LTD. Here, the "light emitting element pitch Pel" corresponds to a pitch in the main scanning direction MD between two light emitting elements 2951 for forming spot latent images adjacent in the main scanning direction MD, and the "spot latent images" are latent images formed on the photosensitive drum surface by the light beams from the light emitting elements 2951 being imaged as spots. Accordingly, as described in detail later with reference to FIG. 17, the spot latent images adjacent in the main scanning direction MD are formed by the light emitting elements 2951 (light emitting elements 2951_1, 2951_2 of FIG. 10, for instance) belonging to different light emitting element rows 2951R.

In this embodiment, a diameter Del of the light emitting element 2951 in the longitudinal direction LGD is larger than the light emitting element pitch Pel to increase the light quantity of the light emitting element 2951.

Wirings WL of one wiring group WLGa are connected with the respective light emitting elements 2951 of the light emitting element row 2951Ra on one half in the width direction LTD of the respective light emitting element rows 2951R of the light emitting element group 295, and wirings WL of an other wiring group WLGb are connected with the respective light emitting elements 2951 of the light emitting element row 2951Rb on the other half. These wiring groups are arranged in different regions. In other words, the one wiring group WLGa is arranged in one wiring region Rwla and the other wiring group WLGb is arranged in the other wiring region Rwlb. The respective wiring groups WLGa, WLGb extend in directions opposite to each other and have substantially the same wiring configurations. Accordingly, the respective wiring groups WLGa, WLGb can be formed by the same pattern, thereby simplifying the wiring formation.

Figure 13:
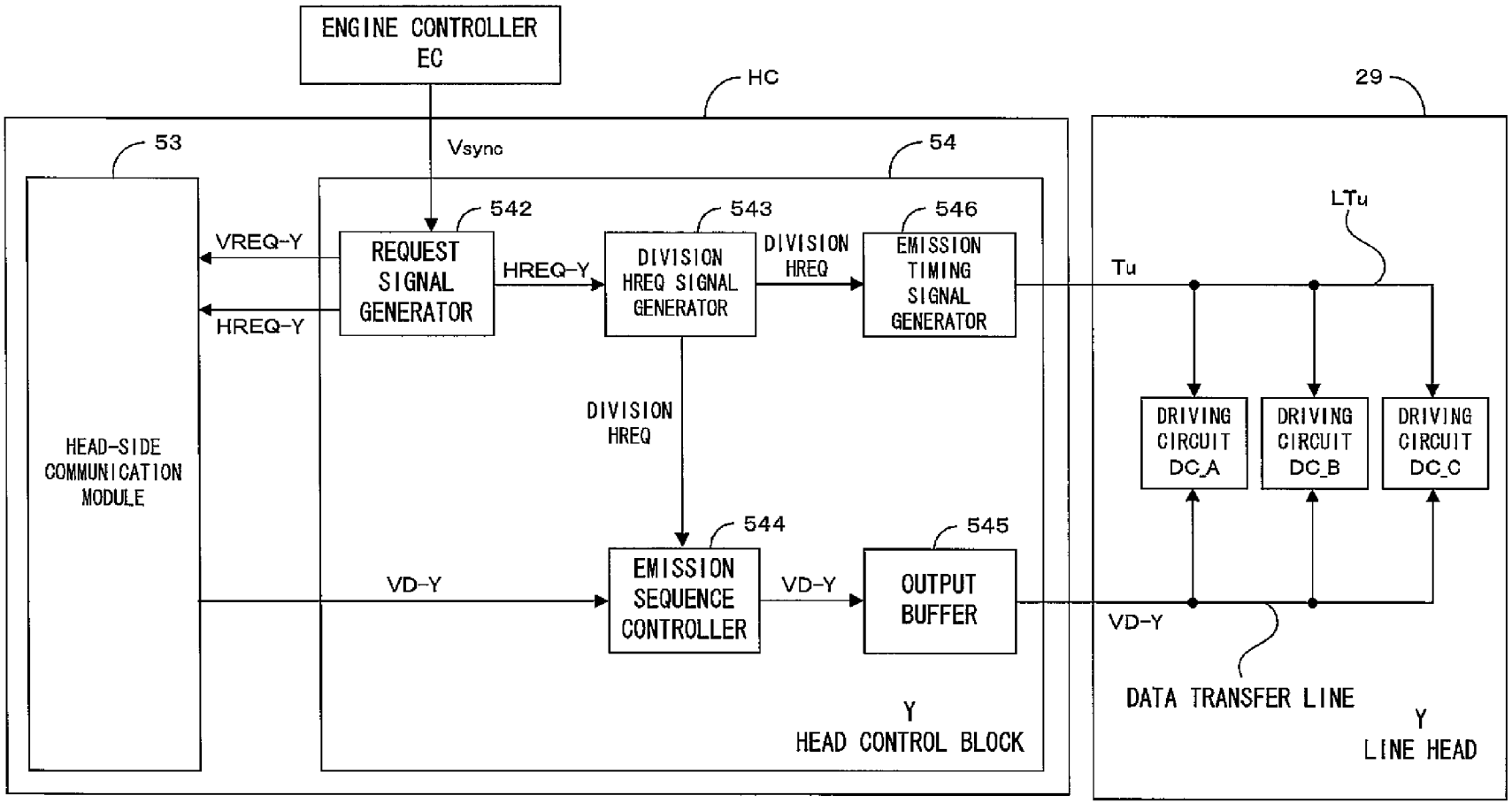
FIG. 13 is a block diagram showing the construction of the head control block in this embodiment.

Driving circuits DC_A (for the light emitting element group row 295R_A), DC_B (for the light emitting element group row 295R_B) and DC_C (for the light emitting element group row 295R_C) are provided via the above wiring WL corresponding to the respective light emitting element group rows 295R_A, 295R_B and 295R_C. These driving circuits DC_A, etc. are constructed, for example, by TFTs (thin film transistors) (FIG. 13). When the driving circuits DC_A, etc. feed drive signals to the respective light emitting elements 2951, the respective light emitting elements 2951 emit light beams of the same wavelength. The light emitting surfaces of the light emitting elements 2951 are so-called perfectly diffusing surface light sources and the light beams emitted from the light emitting surfaces comply with Lambert's cosine law.

The driving operations of the driving circuits DC are controlled based on video data VD. In other words, the main controller MC generates video data VD of one page upon receiving a vertical request signal VREQ from the head controller HC (FIG. 4). Every time the main controller MC receives a horizontal request signal HREQ from the head controller HC, the video data VD of one line is transmitted to the head controller HC. The head controller HC controls the driving circuits DC based on the received video data VD. Next, a specific construction for realizing these control operations is described.

In this embodiment, there are four sets of the respective signals, that is, the request signals VREQ, HREQ transmitted from the head controller HC to the main controller MC and the video data VD transmitted from the main controller MC to the head controller HC corresponding to the respective colors Y, M, C and K. Colors are distinguished below by attaching a hyphen and symbol representing the color to each signal if necessary. For example, the vertical request signal, horizontal request signal and video data for yellow are expressed by VREQ-Y, HREQ-Y and VD-Y.

Figure 11:
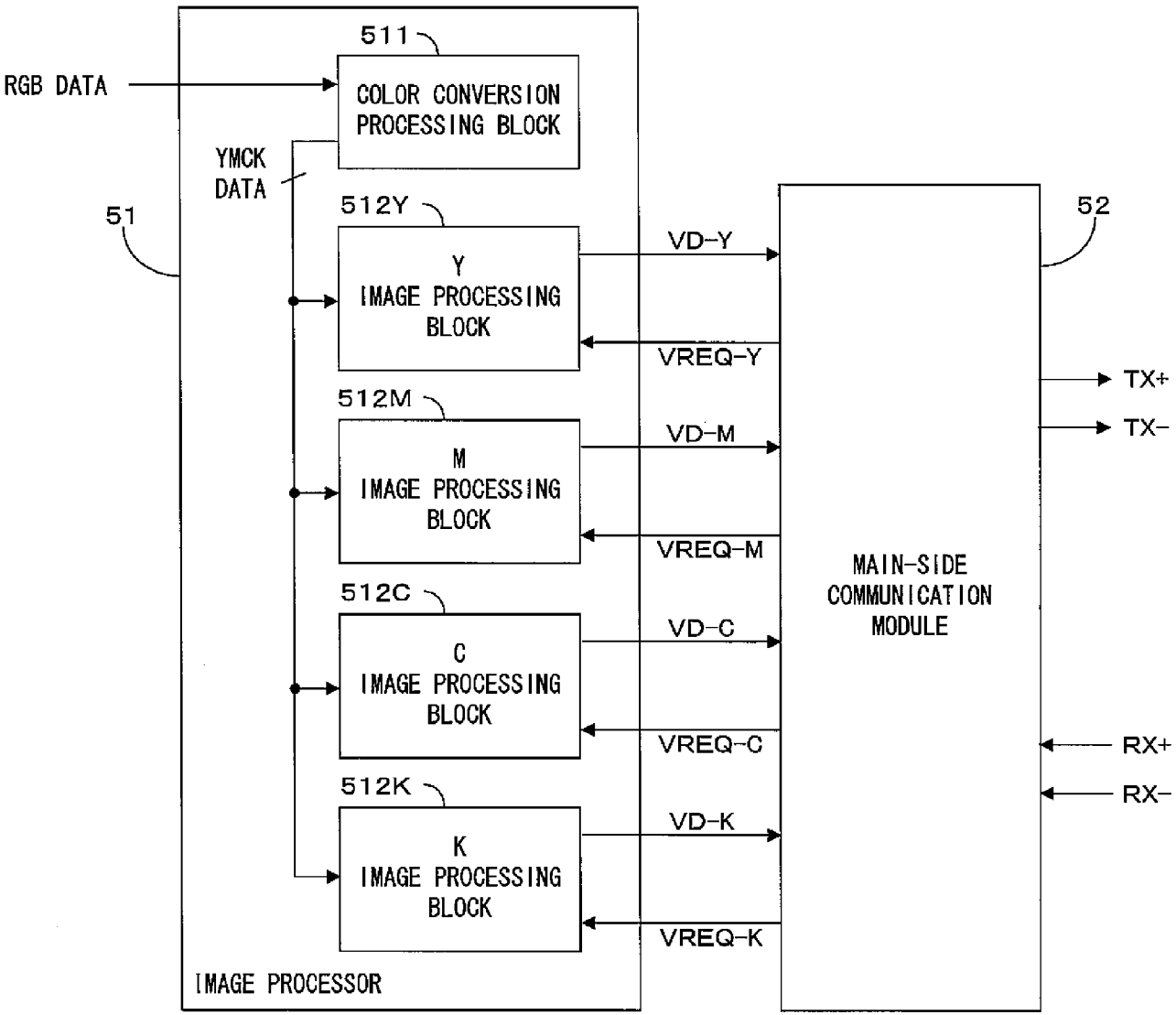
FIG. 11 is a block diagram showing the construction of the main controller.

FIG. 11 is a block diagram showing the construction of the main controller. The main controller MC includes an image processor 51 for applying necessary signal processings to image data included in an image formation command given from an external apparatus, and a main-side communication module 52. The image processor 51 includes a color conversion processing block 511 for expanding RGB image data into YMCK image data corresponding to the respective toner colors. The image processor 51 also includes image processing blocks 512Y (for yellow), 512M (for magenta), 512C (for cyan) and 512K (for black) in correspondence with the respective toner colors, and the following signal processings are applied to the image data. In other words, in the image processing blocks 512Y, etc., the image data is bitmap expanded in accordance with the resolution of the line head 29, and screen processing and gamma correction are performed to the data after the bitmap expansion to generate the video data VD-Y, etc. In this way, the image data is converted into information with pixels as minimum units. Here, the pixels are the minimum units constituting the image to be formed by the line head 29. These series of signal processings are performed for an image of one page every time the vertical request signal VREQ-Y is inputted, and the generated video data VD-Y, etc. are successively outputted line by line to the main-side communication module 52.

In the main-side communication module 52, the video data VD-Y, VD-M, VD-C and VD-K of four colors outputted from the image processor 51 are time-division multiplexed, and the video data VD after multiplexing are serially transmitted to the head controller HC via differential output terminals TX+, TX−. On the other hand, the time-division multiplexed vertical request signals VREQ-Y, VREQ-M, VREQ-C, VREQ-K and horizontal request signals HREQ-Y, HREQ-M, HREQ-C and HREQ-K are inputted from the head controller HC via differential input terminals RX+, RX−. These request signals VREQ, HREQ are parallelly expanded and the vertical request signals VREQ (VREQ-Y, etc.) of the respective colors are inputted to the image processing blocks 512 (512Y, etc.) of the corresponding colors.

Figure 12:
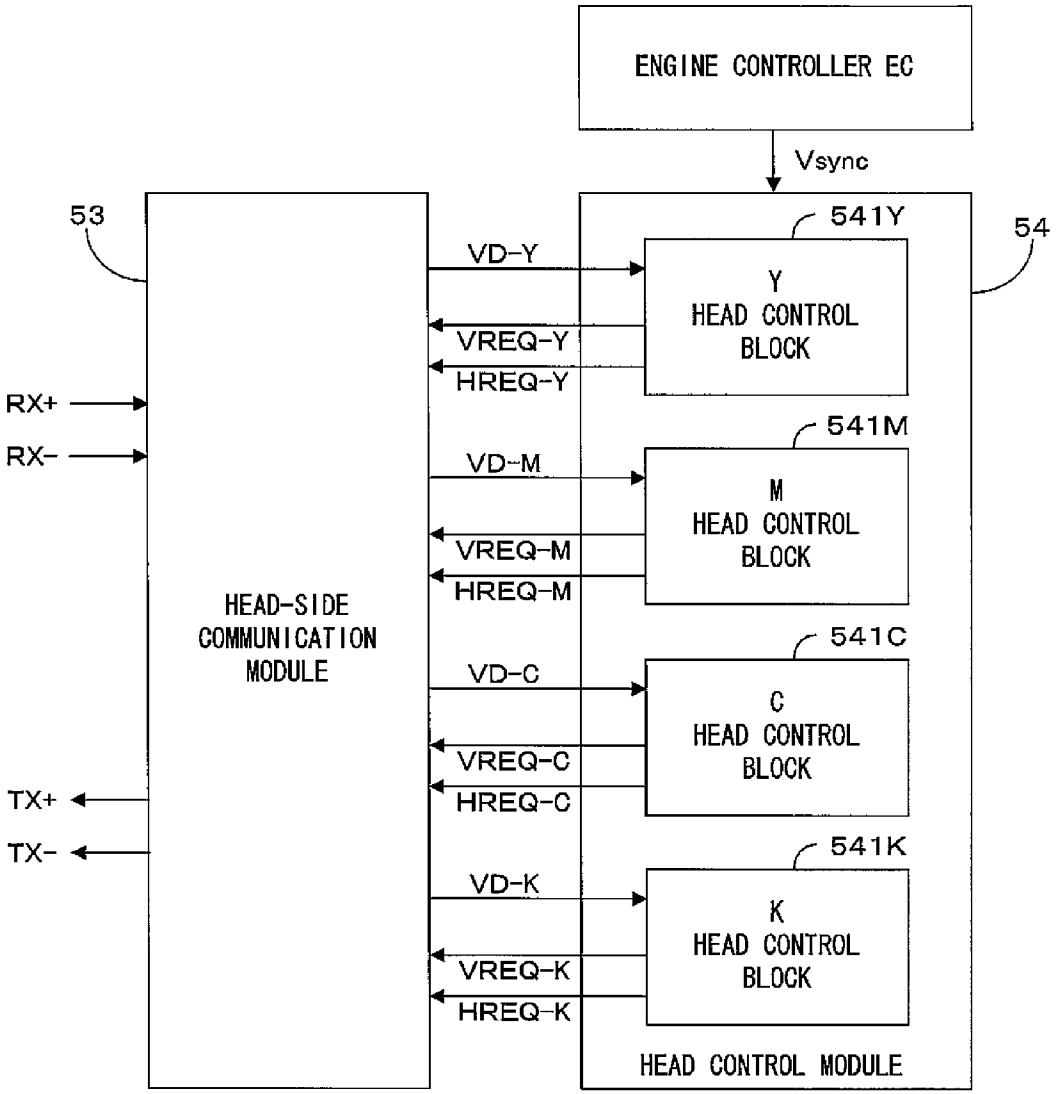
FIG. 12 is a block diagram showing the construction of the head controller.

FIG. 12 is a block diagram showing the construction of the head controller. The head controller HC includes a head-side communication module 53 and a head control module 54. In the head-side communication module 53, the respective request signals of four colors outputted from the head control module 54, that is, vertical request signals VREQ-Y, VREQ-M, VREQ-C, VREQ-K and horizontal request signals HREQ-Y, HREQ-M, HREQ-C and HREQ-K are time-division multiplexed. The time-division multiplexed request signals are serially transmitted to the main controller MC via the differential output terminals TX+, TX−. On the other hand, the time-division multiplexed video data VD-Y, VD-M, VD-C and VD-K are inputted from the main controller MC via the differential input terminals RX+, RX−. These video data VD-Y, etc. are parallelly expanded and inputted to head control blocks 541Y, etc. of the corresponding colors.

In the head control module 54, the four head control blocks 541Y (for yellow), 541M (for magenta), 541C (for cyan) and 541K (for black) are provided in correspondence with the respective colors. The head control blocks 541Y, etc. output the respective request signals VREQ-Y, HREQ-Y, etc. to request the video data VD-Y, etc., whereas they control the exposure operations of the line heads 29 of the corresponding colors based on the received video data VD-Y, etc.

FIG. 13 is a block diagram showing the construction of the head control block in this embodiment. The head control block 541Y for yellow is described here. The other respective blocks 541M, 541C and 541K also have the same construction. The Y head control block 541Y includes a request signal generator 542 for generating the request signals VREQ-Y, HREQ-Y in accordance with a synchronization signal Vsync fed from the engine controller EC. The request signal generator 542 starts counting by means of an internal timer upon receiving the synchronization signal Vsync and outputs the vertical request signal VREQ-Y indicating the head of a page upon the elapse of a specified standby time. Following the output of the vertical request signal VREQ-Y, the request signal generator 542 repeatedly outputs a number of horizontal request signals HREQ-Y corresponding to the number of lines constituting an image of one page in a specified cycle. These request signals VREQ-Y, HREQ-Y are transmitted to the head-side communication module 53 and time division multiplexed together with the request signals of the other colors to be transmitted to the main controller MC.

The horizontal request signal HREQ-Y is further inputted to a division HREQ signal generator 543, which generates a division HREQ signal by multiplying the inputted request signal HREQ-Y, for example, to 16-fold. This division HREQ signal is inputted to an emission sequence controller 544, which rearranges the video data VD-Y in accordance with the division HREQ signal. Such data rearrangement is for rearranging the video data VD-Y received line by line from the head of the page in an order to be transmitted to the driving circuits DC-A, etc.

Figure 14:
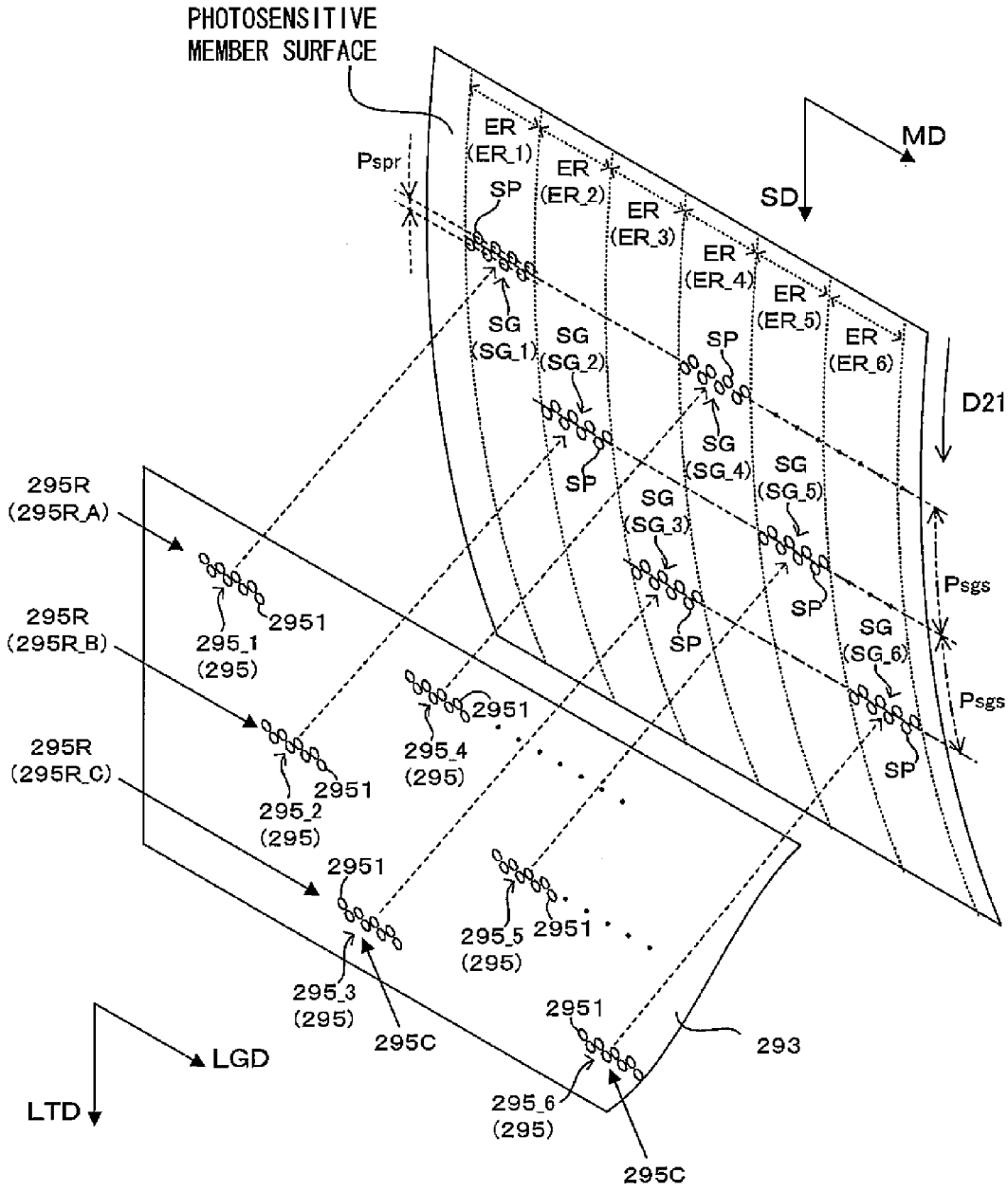
FIG. 14 is a perspective view showing the spot forming operation.
Figure 15:
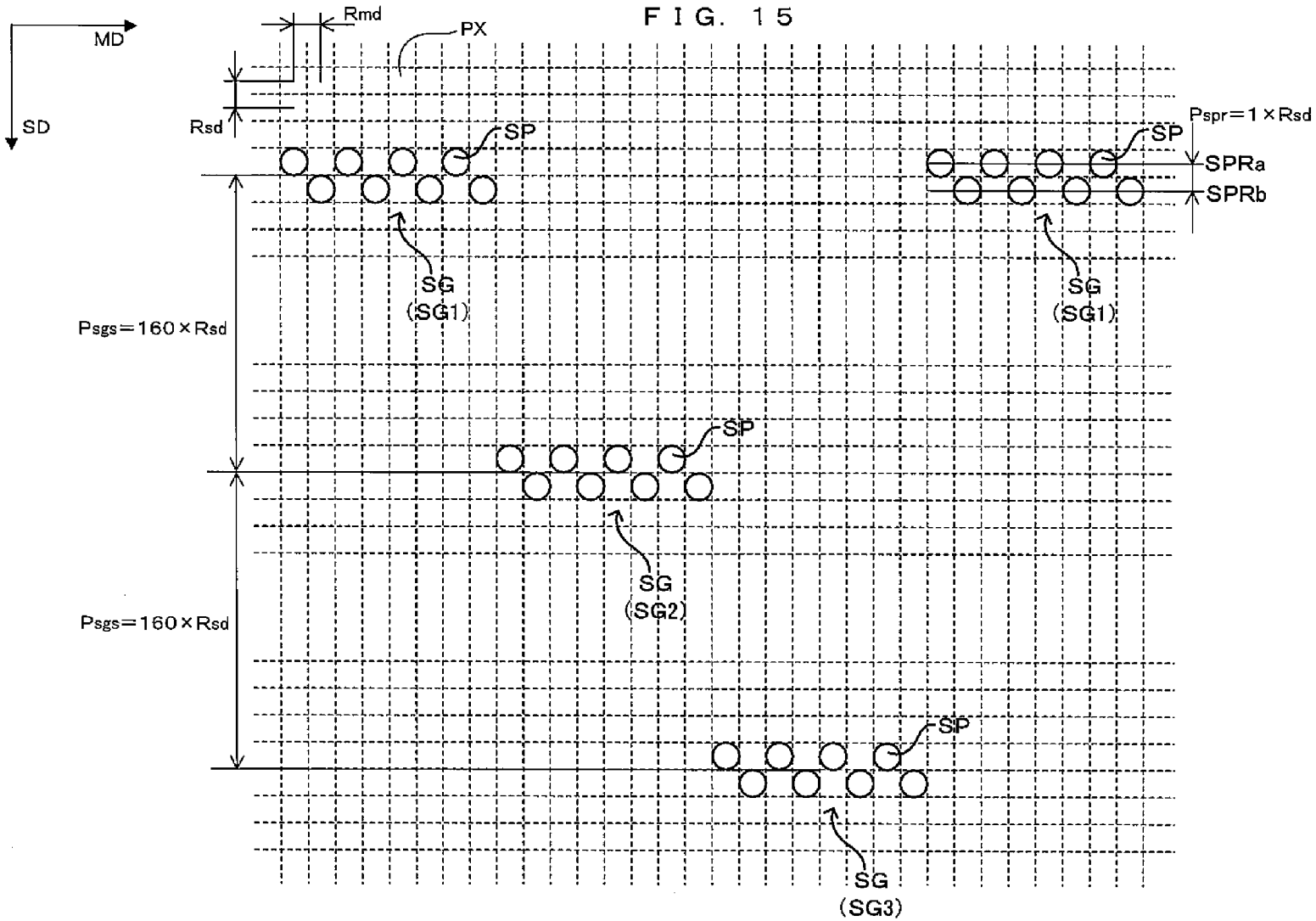
FIG. 15 is a diagram showing spot groups formed on the photosensitive drum surface at the emission switching timing Tu in this embodiment.
Figure 16:
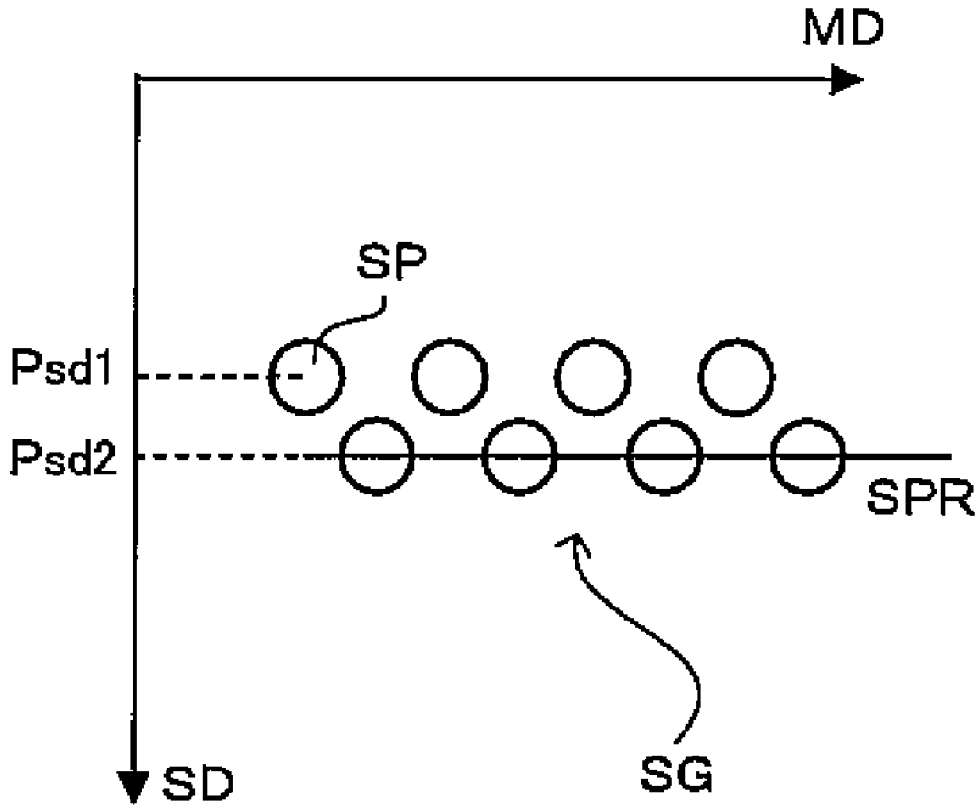
FIG. 16 is a diagram showing the in-group sub-scanning positions.

Specifically, as described later, the respective light emitting element group rows 295R form the spot groups G at positions mutually displaced by a sub-scanning spot group pitch Psgs (FIGS. 14 to 16, etc.). Accordingly, in order to form and arrange spot latent images of one line in the main scanning direction MD, the video data VD-Y need to be transmitted to the driving circuit DC_A, etc., considering differences in the formation positions of the spot groups SG. Specifically, if a value obtained by dividing the sub-scanning spot group pitch Psgs by a sub-scanning pixel pitch Rsd is a "delay line number", the video data VD-Y are rearranged such that the video data VD-Y displaced by the delay line number in the sub scanning direction SD are transmitted to the respective light emitting element group rows 295R_A, etc. at the same timing. For example, at the timing of transmitting the video data VD-Y of the first line to the light emitting element group row 295R_A, the video data VD-Y of the 161st line (=1 line+delay line number) is transmitted to the light emitting element group row 295R_B and the video data VD-Y of the 321st line (=1 line+2(delay line number) is transmitted to the light emitting element group row 295R_C.

An output buffer 545 supplies the thus rearranged video data VD-Y to the respective driving circuits DC_A, DC_B and DC_C via data transfer lines. This output buffer 545 is constructed, for example, by a shift register, and the data transfer lines leading from the output buffer 545 to the respective driving circuits DC_A, etc. are shared among the driving circuits. The driving circuits DC_A, etc. drive the light emitting elements 2951 for light emission based on the video data VD-Y supplied from the output buffer 545. At this time, the driving of the driving circuits DC_A, etc. is performed in synchronism with emission switching timings Tu supplied from an emission timing generator 546 to be described next.

The division HREQ signal is also inputted to the emission timing generator 546, which generates the emission switching timings Tu in accordance with this division HREQ signal. The emission timing generator 546 is connected to the respective driving circuits DC_A etc. via one emission timing control line LTu, which is shared among the driving circuits. The emission timing generator 546 supplies the emission switching timing Tu to the respective driving circuits DC_A, etc. via the emission timing control line LTu. The driving circuits DC_A, etc. drive the light emitting elements 2951 of the corresponding light emitting element group rows 295R_A, etc. at the emission switching timing Tu based on the video data VD-Y supplied beforehand. By controlling the light emissions of the light emitting elements 2951 using the emission switching timing Tu in this way, it becomes possible to form the respective spots SP on the pixels PX of the photosensitive drum surface. Such a spot forming operation is described below.

FIG. 14 is a perspective view showing the spot forming operation, FIG. 15 is a diagram showing spot groups formed on the photosensitive drum surface at the emission switching timing Tu in this embodiment. The lens array 299 is not shown in FIG. 14. Here, the spot formation at the emission switching timing Tu is described after a relationship between the spot groups SG and the pixels PX is described.

As shown in FIG. 14, the respective light emitting element groups 295 can form the spot groups SG in exposure regions ER mutually different in the main scanning direction MD. Here, the spot group SG is a set of a plurality of spots SP formed by the simultaneous light emissions of all the light emitting elements 2951 of the light emitting element group 295. In this embodiment, three light emitting element groups 295 capable of forming the spot groups SG in the exposure regions ER consecutive in the main scanning direction MD are displaced from each other in the width direction LTD. In other words, three light emitting element groups 295_1, 295_2 and 295_3 capable of forming spot groups SG_1, SG_2 and SG_3, for example, in exposure regions ER_1, ER_2 and ER_3 consecutive in the main scanning direction MD are displaced from each other in the width direction LTD. These three light emitting element groups 295 constitute the light emitting element group column 295C, and a plurality of light emitting element group columns 295C are arranged in the longitudinal direction LGD. As a result, three light emitting element group rows 295R_A, 295R_B and 295R_C are arranged in the width direction LTD and the respective light emitting element group rows 295R_A, etc. form the spot groups at positions mutually different in the sub scanning direction SD as already described in the description of FIG. 9.

Figure 17:
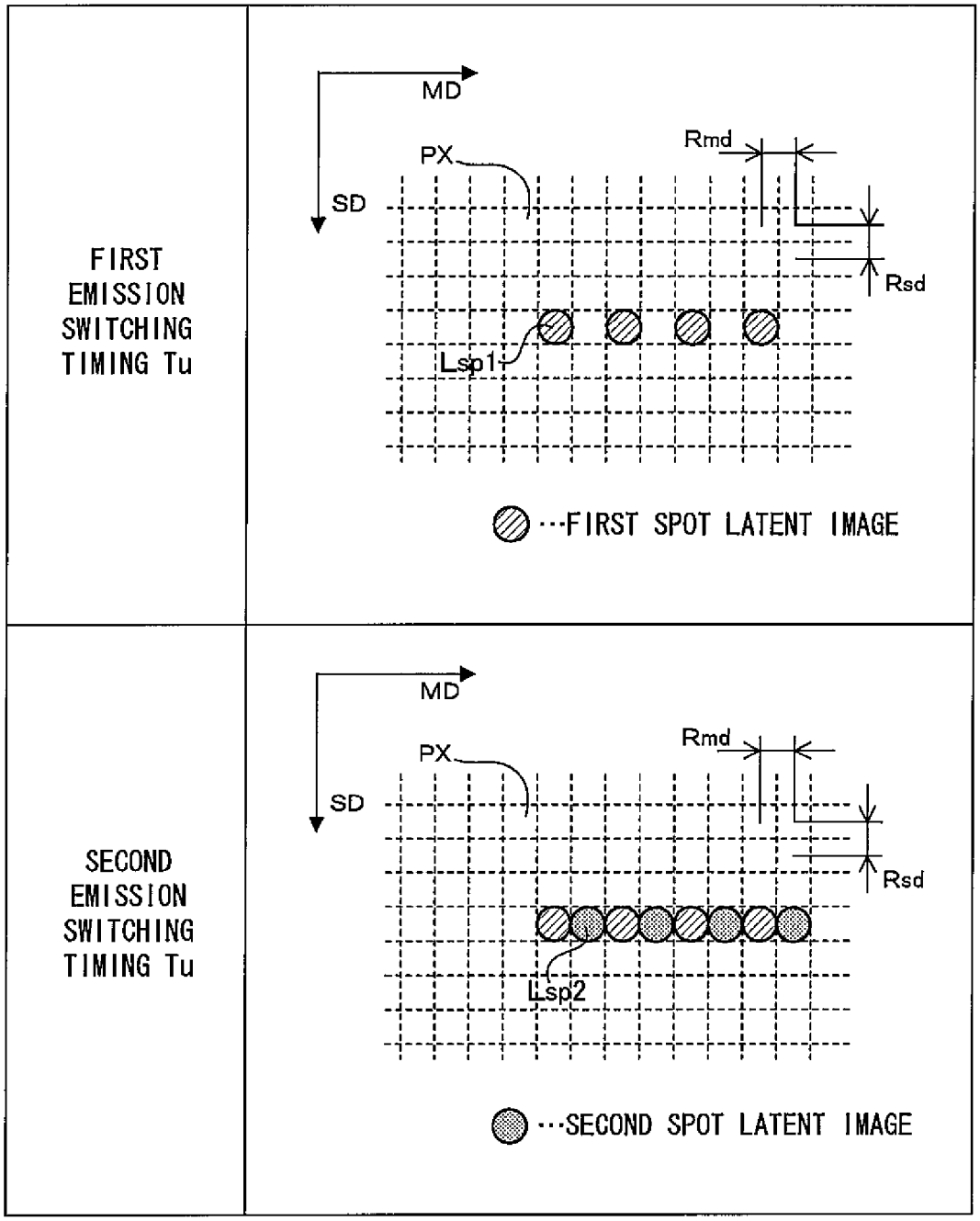
FIG. 17 is a diagram showing an exemplary spot latent image forming operation.

As shown by broken line in FIG. 15, a plurality of pixels PX are virtually provided on the surface of the photosensitive drum 21. A plurality of pixel lines each made up of the pixels PX aligned in the main scanning direction MD are arranged in the sub scanning direction SD. A pitch between adjacent pixels in the main scanning direction MD is a main-scanning pixel pitch Rmd, and a pitch between adjacent pixels in the sub scanning direction SD is a sub-scanning pixel pitch Rsd. In FIGS. 16 and 17, both main-scanning resolution and sub-scanning resolution are 600 dpi (dots per inch) and the main-scanning pixel pitch Rmd and the sub-scanning pixel pitch Rsd are equal. Here, resolution is the density of pixels and indicates the number of pixels per inch.

Incidentally, the pixel pitch on the photosensitive drum surface can be obtained, for example, from a pixel pitch of an image formed on a sheet. However, there are cases where a moving speed of the photosensitive drum surface and a conveying speed of the sheet slightly differ in the sub scanning direction SD. In such cases, the sub-scanning pixel pitch differs between the photosensitive drum surface and the sheet. Accordingly, in the case of obtaining the sub-scanning pixel pitch on the photosensitive drum surface from an image formed on a sheet, the sub-scanning pixel pitch obtained from the image on the sheet may be multiplied by a speed ratio of the moving speed of the photosensitive drum surface to the conveying speed of the sheet. A value or the like written in the specification of the image forming apparatus such as a printer can be used as this speed ratio.

As shown in FIGS. 14 and 15, two spot rows SPRa, SPRb are arranged at the spot row pitch Pspr in the sub scanning direction SD in each spot group SG. The spot rows are identified by SPRa, SPRb in FIG. 15 and the spot rows identified by the same reference numerals have the same positions (in-group sub-scanning positions) in the sub scanning direction SD in the spot groups SG. Here, the "in-group sub-scanning position" is the position of an object (spot or spot row) in the sub scanning direction SD with respect to MD-SD coordinate axes provided for each spot group SG. For example, in FIG. 16, the in-group sub-scanning position of the spot SP is a position Psd1, and the in-group sub-scanning position of the spot row SPR is a position Psd2. FIG. 16 is a diagram showing the in-group sub-scanning positions.

In this embodiment, this spot row pitch Pspr is not set to be an integral multiple (one-fold) of the sub-scanning pixel pitch Rsd (FIG. 15). The spot groups SG formed by the different light emitting element group rows 295R are at positions different in the sub scanning direction SD, and these spot groups SG are arranged at the sub-scanning spot group pitches Psgs in the sub scanning direction SD. This sub-scanning spot group pitch Psgs is set to be an integral multiple (160-fold) of the sub-scanning pixel pitch Rsd. In this embodiment, the line head 29 is constructed such that the pitch Pegr between the light emitting element groups in the longitudinal direction LTD and the pitch Plsr between the lenses LS in the longitudinal direction LTD are equal and an integral multiple of the sub-scanning pixel pitch (160-fold). In other words, by constructing the line head 29 in this way, the sub-scanning spot group pitch Psgs can be easily set to an integral multiple of the sub-scanning pixel pitch Rsd.

As described above, in the line head of this embodiment, the sub-scanning spot group pitch Psgs is set to the integer multiple of the sub-scanning pixel pitch Rsd. Further, in this embodiment, the pitch between the spots SP formed at the positions different in the sub scanning direction SD in each spot group SG is set to the integral multiple (one-fold) of the sub-scanning pixel pitch Rsd. In other words, the pitch Pspr in the sub scanning direction SD between the spot rows SPRa, SPRb arranged in the sub scanning direction SD is set to the integral multiple (one-fold) of the sub-scanning pixel pitch Rsd.

Accordingly, in this embodiment, all the spots SP can be simultaneously formed on the pixels PX at an emission switching timing Tu. Thus, only by controlling all the light emitting elements 2951 at the same emission switching timing Tu, the spots SP can be properly formed on the respective pixels PX, whereby an emission switching timing control is simplified. Further, since all the light emitting elements 2951 can be controlled at the same emission switching timing Tu, one emission timing control line LTu can be commonly used among all the light emitting element group rows 295R_A, 295R_B and 295R_C, whereby the construction of the line head 29 is simplified (FIG. 13).

In this embodiment, by driving the respective light emitting elements 2951 of the light emitting element group at the emission switching timing Tu while the surface of the photosensitive drum 21 is moved in the sub scanning direction SD, a plurality of spot latent images Lspa aligned in the main scanning direction MD can be formed.

FIG. 17 is a diagram showing an exemplary spot latent image forming operation. When the light emitting element row 2951Ra (FIG. 10) is driven to emit lights at the emission switching time Tu to form the respective spots SP of the spot row SPRa as shown in the column "FIRST EMISSION SWITCHING TIMING Tu" of FIG. 17, the spot latent images Lspa are formed on the respective pixels PX. Subsequently, when the surface of the photosensitive drum 21 is moved by a distance corresponding to one-fold of the sub-scanning pixel pitch Rsd, the light emitting element row 2951Rb are driven to emit lights at the second emission switching timing Tu. Thus, the respective spots SP of the spot row SPRb are formed to form the spot latent images Lspb on the respective pixels PX. In this way, the respective light emitting elements 2951 emit lights in conformity with the movement of the photosensitive drum surface, whereby a plurality of spot latent images Lspa aligned in the main scanning direction MD can be formed. Thus, in this embodiment, the spot latent images adjacent in the main scanning direction MD (adjacent spot latent images) are formed by two light emitting elements 2951 belonging to the different light emitting element rows 2951R. In other words, for example, out of the two light emitting elements 2951_1, 2951_2 for forming the adjacent spot latent images Lsp1, Lsp2, the light emitting element 2951_1 belongs to the light emitting element row 2951Ra, whereas the light emitting element 2951_2 belongs to the light emitting element row 2951Rb.

As described above, in this embodiment, a plurality of light emitting elements 2951 are arranged while being grouped into the light emitting element groups 295. In each light emitting element group 295, the light emitting element rows 2951R each including a plurality of light emitting elements 2951 aligned in the longitudinal direction LGD are arranged in the width direction LTD. In addition, the respective light emitting element rows 2951 are displaced from each other in the longitudinal direction LGD such that two light emitting elements 2951 for forming spot latent images adjacent in the main scanning direction MD belong to different light emitting element rows 2951R. In other words, the two light emitting elements 2951 for forming the spot latent images adjacent in the main scanning direction MD are displaced from each other in the width direction LTD. Accordingly, relatively large inter-element spaces BE can be ensured between the light emitting elements aligned in the longitudinal direction LGD in the light emitting element row 2951R (FIG. 10). Thus, the light emitting elements 2951 can be formed in relatively large spaces, wherefore the light emitting elements 2951 can be enlarged. As a result, a spot latent image can be formed with a sufficient light quantity even at a high resolution and the formation of a good spot latent image is possible.

Further, in this embodiment, an even number of light emitting element rows 2951R are provided in each light emitting element group 295. Accordingly, it is possible to divide these light emitting element rows 2951R into the light emitting element row 2951Ra on one half in the width direction LTD (one light emitting element row 2951Ra) and the light emitting element row 2951Rb on the other half (other light emitting element row 2951Rb) and to arrange the wirings WL for the respective light emitting element rows. Specifically, as shown in FIG. 10, the respective wirings WL of the one wiring group WLGa are connected with the corresponding light emitting elements 2951 of the one light emitting element row 2951Ra, and the respective wirings WL of the other wiring group WLGb are connected with the corresponding light emitting elements 2951 of the other light emitting element row 2951Rb. The one wiring group WLGa is provided in the one wiring region Rwla, whereas the other wiring group WLGb is provided in the other wiring region Rwlb. In this way, the wirings of the light emitting element group 295 are divided into two wiring groups and the respective wiring groups are provided in different regions, whereby the number of the wirings WL passing the inter-element spaces BE can be suppressed. This is described in detail below.

Figure 18:
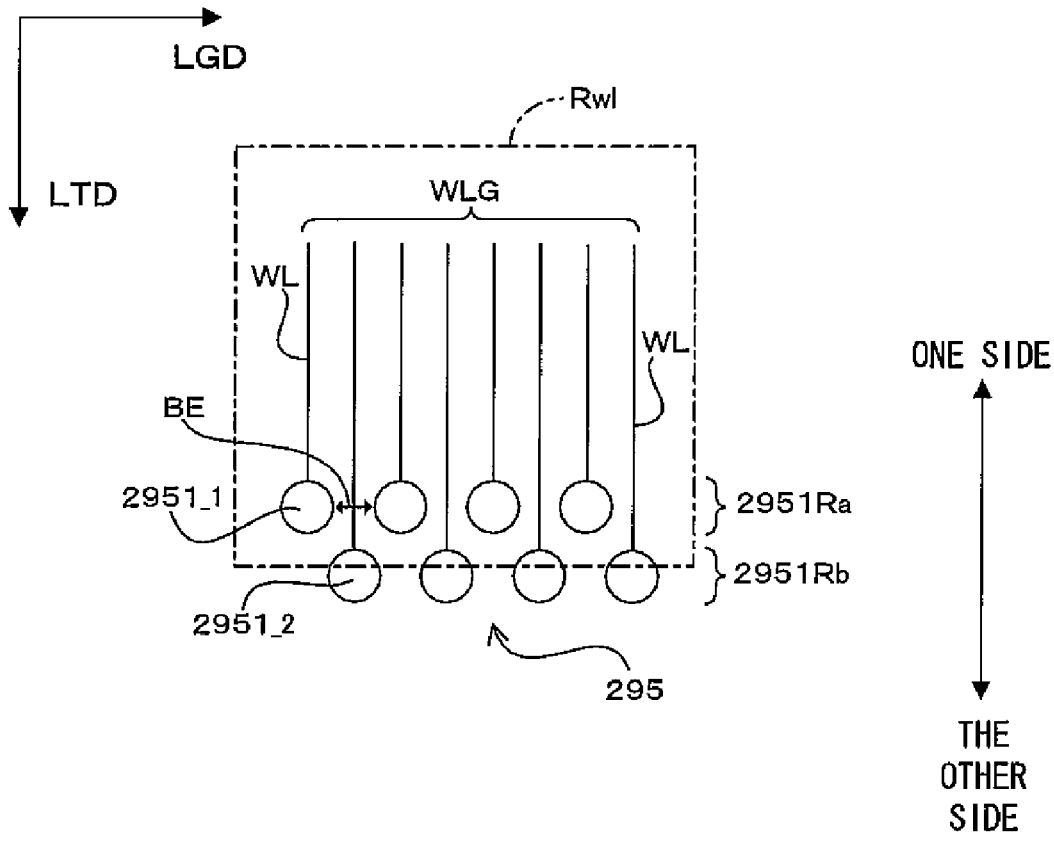
FIG. 18 is a diagram showing a case where the wirings of the light emitting element group are provided in one region.

FIG. 18 is a diagram showing a case where the wirings of the light emitting element group are provided in one region. In FIG. 18, the wirings WL (wiring group WLG) are provided only at one side of the light emitting element group 295 in the width direction LTD. In such a wiring configuration, the wirings to the other light emitting element row 2951Rb pass the inter-element spaces BE of the one light emitting element row 2951Ra. In contrast, in FIG. 10 showing the wiring configuration of this embodiment, the wirings to the other light emitting element row 2951Rb do not pass the inter-element spaces BE of the one light emitting element row 2951Ra. Thus, the number of the wirings WL passing the inter-element spaces BE can be suppressed and this embodiment has a construction advantageous in enlarging the light emitting elements 2951.

In the above embodiment, organic EL devices are used as the light emitting elements 2951. The organic EL devices have a smaller light quantity, for example, as compared with LEDs (light emitting diodes) and the like. Accordingly, the application of the invention enabling the enlargement of the light emitting elements 2951 is particularly preferable for the construction using the organic EL devices.

Above all, bottom emission-type organic EL devices used in the above embodiment have a smaller light quantity. Accordingly, the application of the invention enabling the enlargement of the light emitting elements 2951 is very preferable for the construction using the bottom emission-type organic EL devices.

As described above, in the above embodiment, the line head 29 corresponds to an "exposure head" of the invention, the main scanning direction MD and the longitudinal direction LGD to a "first direction" of the invention, the sub scanning direction SD and the width direction LTD to a "second direction" of the invention, the lens LS to an "imaging optical system" of the invention, the photosensitive drum 21 to a "latent image carrier" of the invention, the surface of the photosensitive drum 21 to an "image plane" of the invention, and the head substrate 293 to a "substrate" of the invention. Further, the diameter Del of the light emitting element 2951 in the longitudinal direction LGD corresponds to a "first-direction width" of the light emitting element of the invention, and the spot SP to a "focused portion" of the invention. Further, the one side in the width direction LTD corresponds to a "first side" of the invention, and the other side in the width direction LTD to a "second side" of the invention. Further, the pitch in the sub scanning direction SD between the spots SP formed at positions different from each other corresponds to a "distance between the focused portions" of the invention, the sub-scanning pixel pitch Rsd to a "distance between the pixels" of the invention, and the light emitting element pitch Pel to a "distance between the light emitting elements" of the invention.

Miscellaneous

The invention is not limited to the above embodiment and various changes other than the above can be made without departing from the gist thereof. For example, the light emitting element group 295 is made up of two light emitting element rows 2951R arranged in the width direction LTD in the above embodiment. However, the number of the light emitting element rows 2951R is not limited to two and is sufficient to be an even number.

Figure 19:
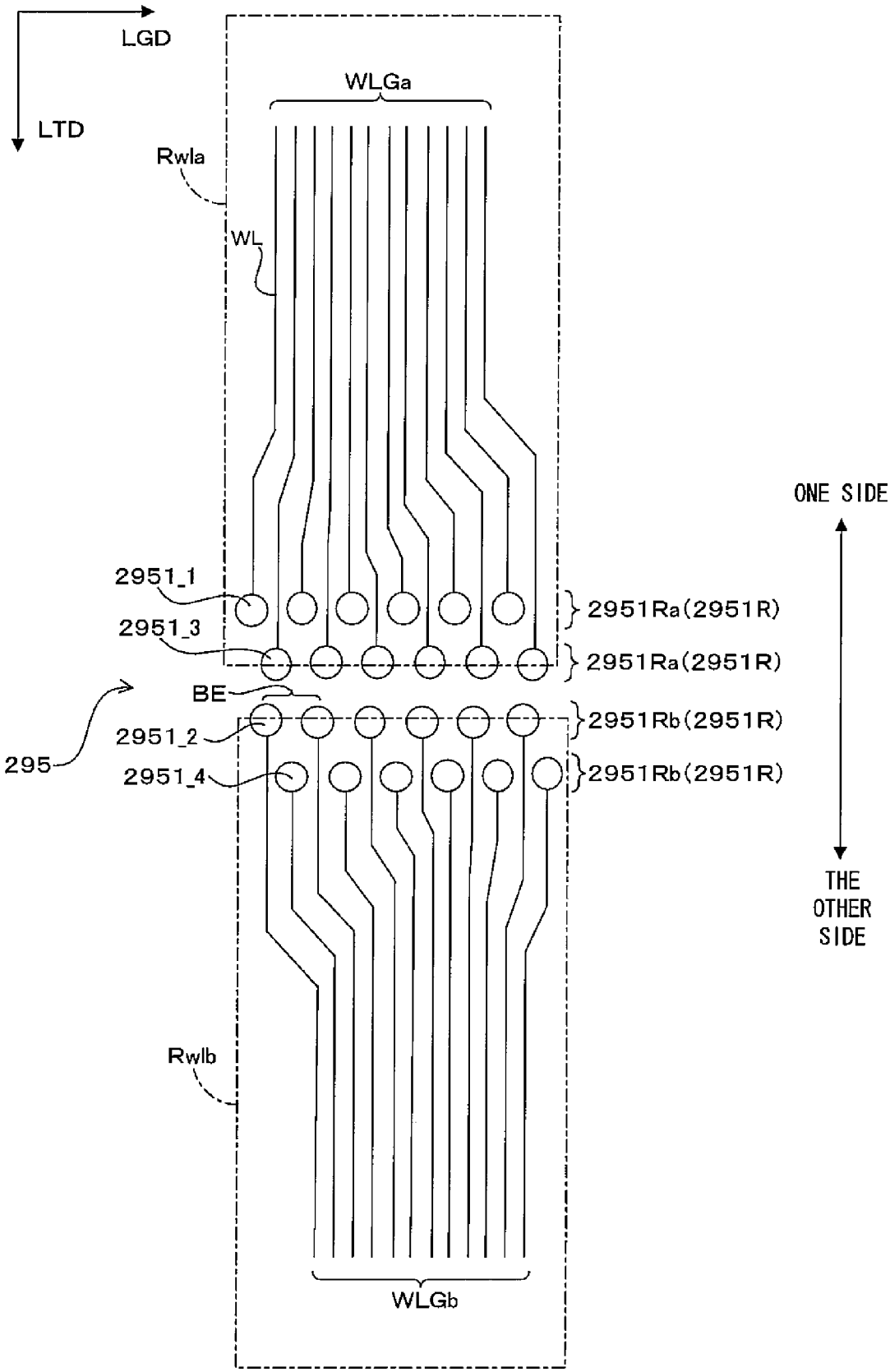
FIG. 19 is a diagram showing another configuration of a light emitting element group.

FIG. 19 is a diagram showing another configuration of a light emitting element group. As shown in FIG. 19, a light emitting element group 295 is made up of four light emitting element rows 2951R arranged in the width direction LTD. Each light emitting element row 2951R is made up of seven light emitting elements 2951 aligned in the longitudinal direction LGD. The respective light emitting element rows 2951R are arranged while being displaced from each other in the width direction LTD. As a result, two light emitting elements (for example, light emitting elements 2951_1, 2951_2 or light emitting elements 2951_2, 2951_3 or light emitting elements 2951_3, 2951_4) for forming adjacent spot latent images belong to different light emitting element rows 2951R.

In this way, in the other configuration shown in FIG. 19, an even number of light emitting element rows 2951R are provided. Accordingly, it is possible to divide these light emitting element rows 2951R into two light emitting element rows 2951Ra (one light emitting element rows 2951Ra) on one half in the width direction LTD and two light emitting element rows 2951Rb (other light emitting element rows 2951Rb) on the other half and to arrange wirings WL for the respective light emitting element rows. Specifically, as shown in FIG. 19, the respective wirings WL of one wiring group WLGa are connected with the corresponding light emitting elements 2951 of the one light emitting element rows 2951Ra and the wirings WL of another wiring group WLGb are connected with the corresponding light emitting elements 2951 of the other light emitting element rows 2951Rb. The one wiring group WLGa is provided in one wiring region Rwla, whereas the other wiring group WLGb is provided in another wiring region Rwlb. By dividing the wirings for the light emitting element group 295 into two wiring groups and providing the respective wiring groups in the different regions in this way, the number of the wirings WL passing inter-element spaces BE can be suppressed. This is described in detail below.

Figure 20:
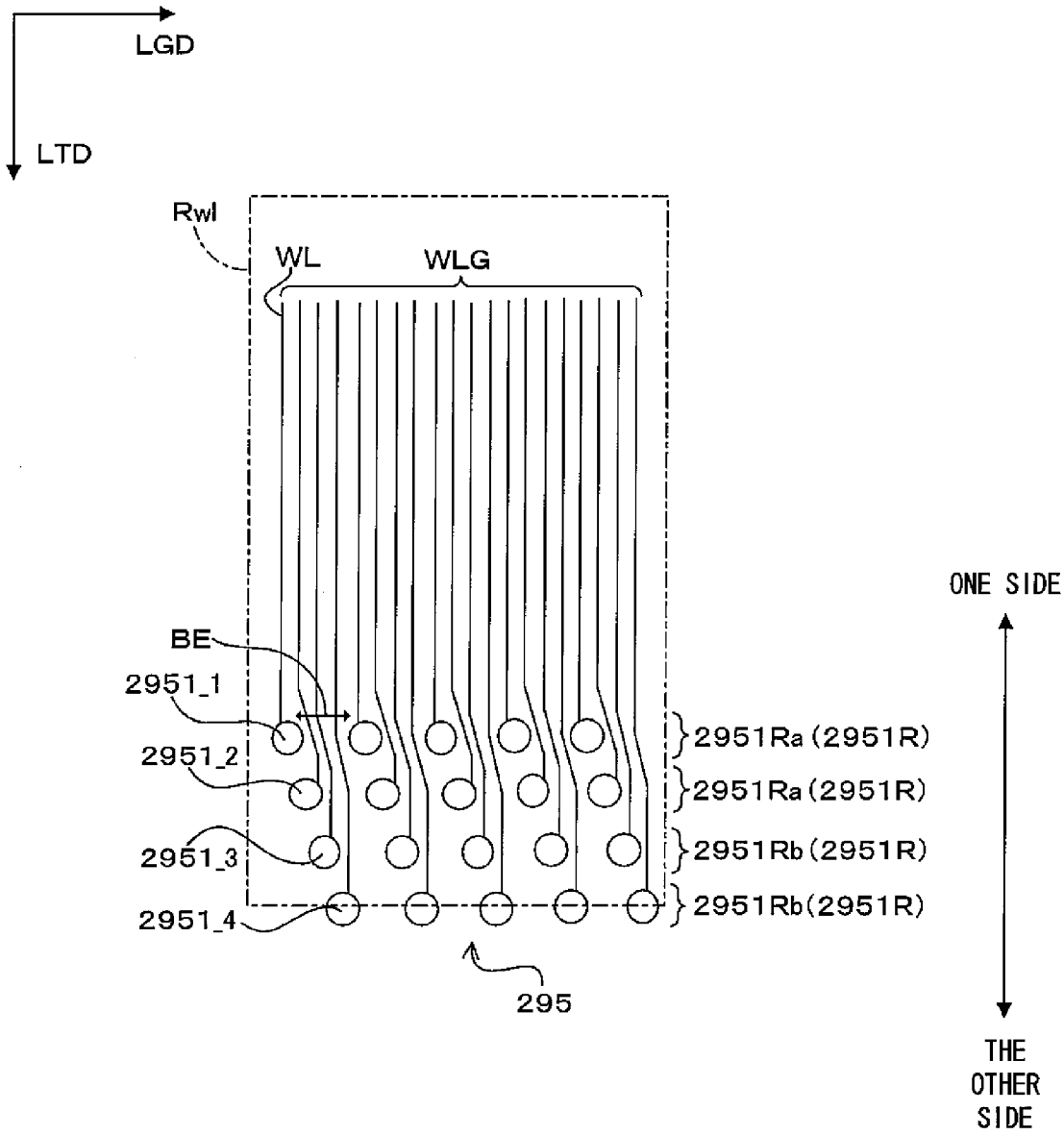
FIG. 20 is a diagram showing a case where the wirings of the light emitting element group are provided only in one region.

FIG. 20 is a diagram showing a case where the wirings of the light emitting element group are provided only in one region. In FIG. 20, the wirings WL (wiring group WLG) are provided only at one side of the light emitting element group 295 in the width direction LTD. In such a wiring configuration, the wirings to the other light emitting element rows 2951Rb pass the inter-element spaces BE of the one light emitting element rows 2951Ra. In contrast, in FIG. 19 showing the wiring configuration of this embodiment, the number of the wirings WL passing the inter-element spaces BE can be suppressed and this embodiment has a construction advantageous in enlarging the light emitting elements 2951.

Figure 21:
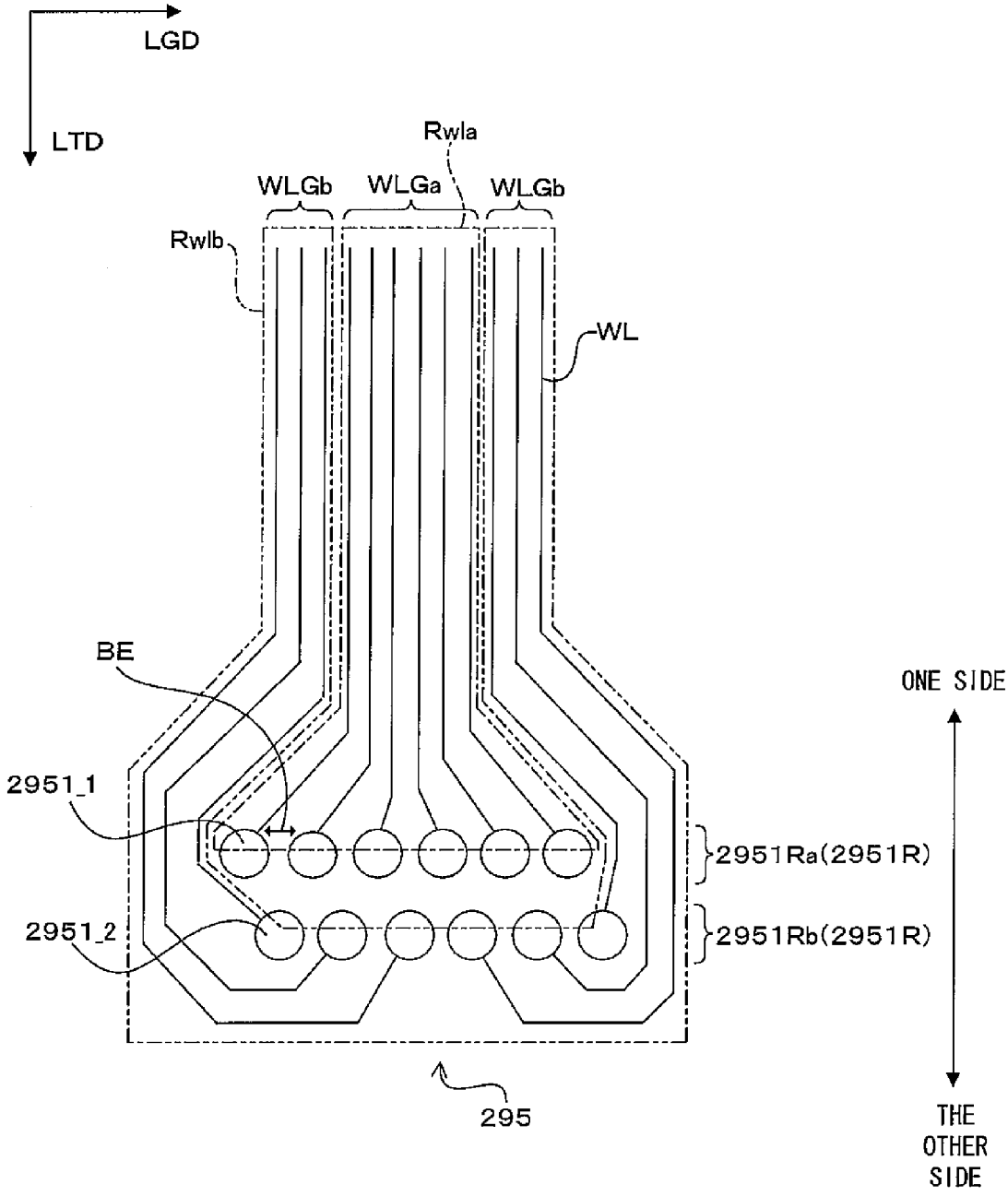
FIG. 21 is a diagram showing another arrangement mode of wiring groups.

Although the respective wiring groups WLGa, WLGb extend in directions opposite to each other in the above embodiment, the arrangement mode thereof is not limited to this. FIG. 21 is a diagram showing another arrangement mode of wiring groups. In FIG. 21, a light emitting element row 2951R is formed by aligning seven light emitting elements 2951 in the longitudinal direction LGD and two light emitting element rows 2951R are arranged in the width direction LTD to form a light emitting element group 295. The respective light emitting element rows 2951R are arranged while being displaced from each other in the width direction LTD. As a result, two light emitting elements (light emitting elements 2951_1, 2951_2, for instance) for forming adjacent spot latent images belong to different light emitting element rows 2951R.

In this other arrangement mode as well, an even number of light emitting element rows 2951R are provided. These light emitting element rows 2951R are divided into the light emitting element row 2951Ra (one light emitting element row 2951Ra) on one half in the width direction LTD and the light emitting element row 2951Rb (other light emitting element row 2951Rb) on the other half and wirings WL are arranged for the respective light emitting element rows. Specifically, the respective wirings WL of one wiring group WLGa are connected with the corresponding light emitting elements 2951 of the one light emitting element row 2951Ra and the wirings WL of another wiring group WLGb are connected with the corresponding light emitting elements 2951 of the other light emitting element row 2951Rb. The one wiring group WLGa is provided in one wiring region Rwla, whereas the other wiring group WLGb is provided in another wiring region Rwlb. In this other arrangement mode, the one wiring group WLGa extends toward the one side as it is, whereas the other wiring group WLGb is drawn toward the one side after circumventing the light emitting element group 295 at the opposite sides in the longitudinal direction LGD.

In this way, the respective wiring groups WLGa, WLGb are provided in the different regions Rwla, Rwlb in this other arrangement mode as well. Accordingly, in this other arrangement mode, it is possible to suppress the number of the wirings WL passing inter-element spaces BE and to enlarge the light emitting elements 2951.

The arrangement modes of the light emitting element group and the wirings may also be modified as shown in FIGS. 22 to 25. FIGS. 22 to 25 are plan views showing modifications of the arrangement modes of the light emitting element group and the wirings, wherein the under surface of the head substrate 293 is shown. In FIGS. 22 to 25, the lens LS is shown by chain double-dashed line to show a relationship of the lens LS and the light emitting element group 295, but not to show that the lens LS is arranged on the under surface of the head substrate 293.

Figure 22:
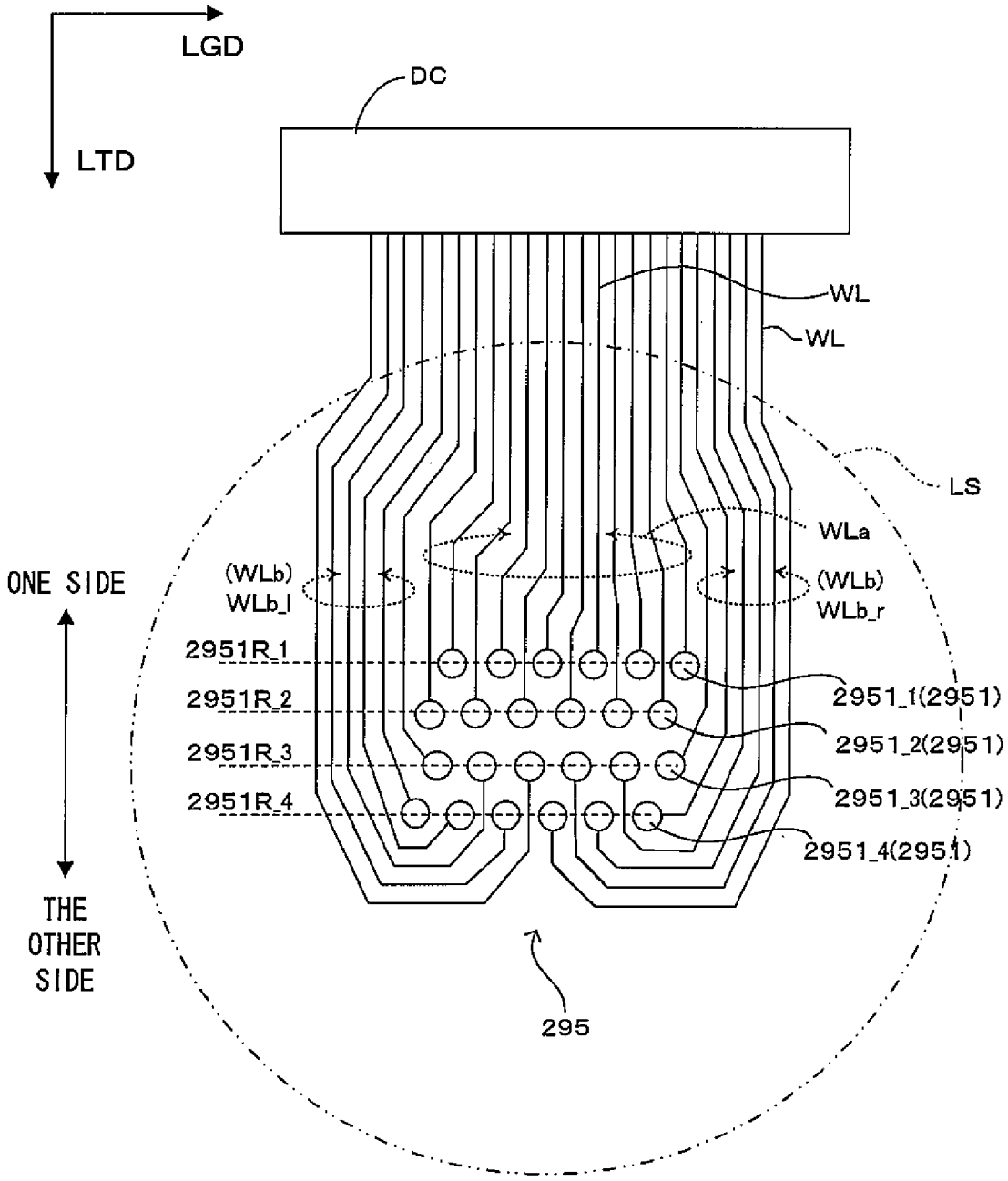
FIGS. 22 to 25 are plan views showing modifications of the arrangement modes of the light emitting element group and the wirings.

First of all, the modification shown in FIG. 22 is described. As shown in FIG. 22, four light emitting element rows 2951_1 to 2951_4 are arranged in the width direction LTD in the light emitting element group 295. In each of the light emitting element rows 2951R_1 to 2951R_4, six light emitting elements 2951 are linearly aligned in the longitudinal direction LGD. The respective light emitting element rows 2951R_1 to 2951_4 are displaced from each other in the longitudinal direction LGD, so that the positions of the respective light emitting elements 2951 of the light emitting element group 295 mutually differ in the longitudinal direction LGD. Accordingly, the positions of spots SP to be formed by the respective light emitting elements 2951 also differ in the main scanning direction MD. Further, the positions of four light emitting elements 2951 (for example, light emitting elements 2951_1 to 2951_4) for forming spots SP adjacent in the main scanning direction MD are mutually different in the width direction LTD.

A driving circuit DC (electric circuit) is provided at one side of the light emitting element group 295 in the width direction LTD. This driving circuit DC drives the respective light emitting elements 2951 via wirings WL. In other words, in this modification, signals with less dampening caused by the stray capacitances of the wirings WL can be supplied to the light emitting elements 2951 by providing the driving circuit DC near the light emitting element group 295. The wirings WL connecting the light emitting elements 2951 and the driving circuit DC are arranged as follows. Specifically, the respective wirings WLa (first wiring) connected with one half of the four (namely, two) light emitting element rows 2951R at one side in the width direction LTD, that is, the light emitting element rows 2951R_1, 2951R_2, are drawn toward the one side in the width direction LTD and connected with the driving circuit DC. Further, the respective wirings WLb (second wiring) connected with the other half (namely, two) at the other side in the width direction LTD, that is, the light emitting element rows 2951R_3, 295R_4, are also drawn toward the one side in the width direction LTD. However, these wirings WLb are drawn while circumventing the light emitting element rows 2951R_1, 2951R_2 and the respective wirings WLa. More specifically, in FIG. 22, the wirings WLb_r connected with six light emitting elements 2951 at the right sides of the light emitting element rows 2951R_3, 2951R_4 are drawn while circumventing the light emitting element rows 2951R_1, 2951R_2 and the like toward the right side. On the other hand, the wirings WLb_1 connected with six light emitting elements 2951 at the left sides are drawn while circumventing the light emitting element rows 2951R_1, 2951R_2 and the like toward the left side. The respective wirings WLb drawn in this way are connected with the driving circuit DC.

As described above, the modification shown in FIG. 22 also has a configuration advantageous in enlarging the light emitting elements 2951 similar to the above embodiment. In other words, in this modification, 2N (that is, an even number of) light emitting element rows 2951R are provided. N is a positive integer and N=2 in this modification. N light emitting elements 2951 belonging to different light emitting element rows 2951R and adapted to consecutively form spots in the main scanning direction MD are arranged at positions different in the width direction LTD instead of being linearly arranged as in the related art. Accordingly, the light emitting elements 2951 can be formed in relative large spaces, wherefore the light emitting elements 2951 can be enlarged. Similar to the above embodiment, 2N (that is, an even number of) light emitting element rows 2951R are provided in the light emitting element group 295 also in this modification, which is advantageous in suppressing the number of the wirings passing between the light emitting elements 2951.

In other words, the respective wirings WL are arranged as described with reference to FIG. 22. Thus, the wirings WLa connected with the respective light emitting elements 2951 of the N light emitting element rows 2951R_1, 2951R_2 at the one side in the width direction LTD do not pass between the respective light emitting elements 2951 of the N light emitting element rows 2951R_3, 2951R_4 at the other side in the width direction LTD. Similarly, the wirings WLb connected with the respective light emitting elements 2951 of the N light emitting element rows 2951R_3, 2951R_4 at the other side in the width direction LTD do not pass between the respective light emitting elements 2951 of the N light emitting element rows 2951R_1, 2951R_2 at the one side in the width direction LTD. In this way, the number of the wirings passing between the light emitting elements 2951 can be suppressed and the light emitting elements 2951 can be relatively easily enlarged. As a result, a good latent image can be formed with a sufficient light quantity even at a high resolution.

This modification is particularly preferable for the line head 29 including two light emitting element group rows 295R. This is because all the wirings WL from the respective light emitting element groups 295 of the light emitting element row 295R at one side in the width direction LTD can be drawn toward the one side and all the wirings WL from the respective light emitting element groups 295 of the light emitting element row 295R at the other side in the width direction LTD can be drawn toward the other side, and the wirings WL can be easily arranged for the light emitting elements 2951.

Figure 23:
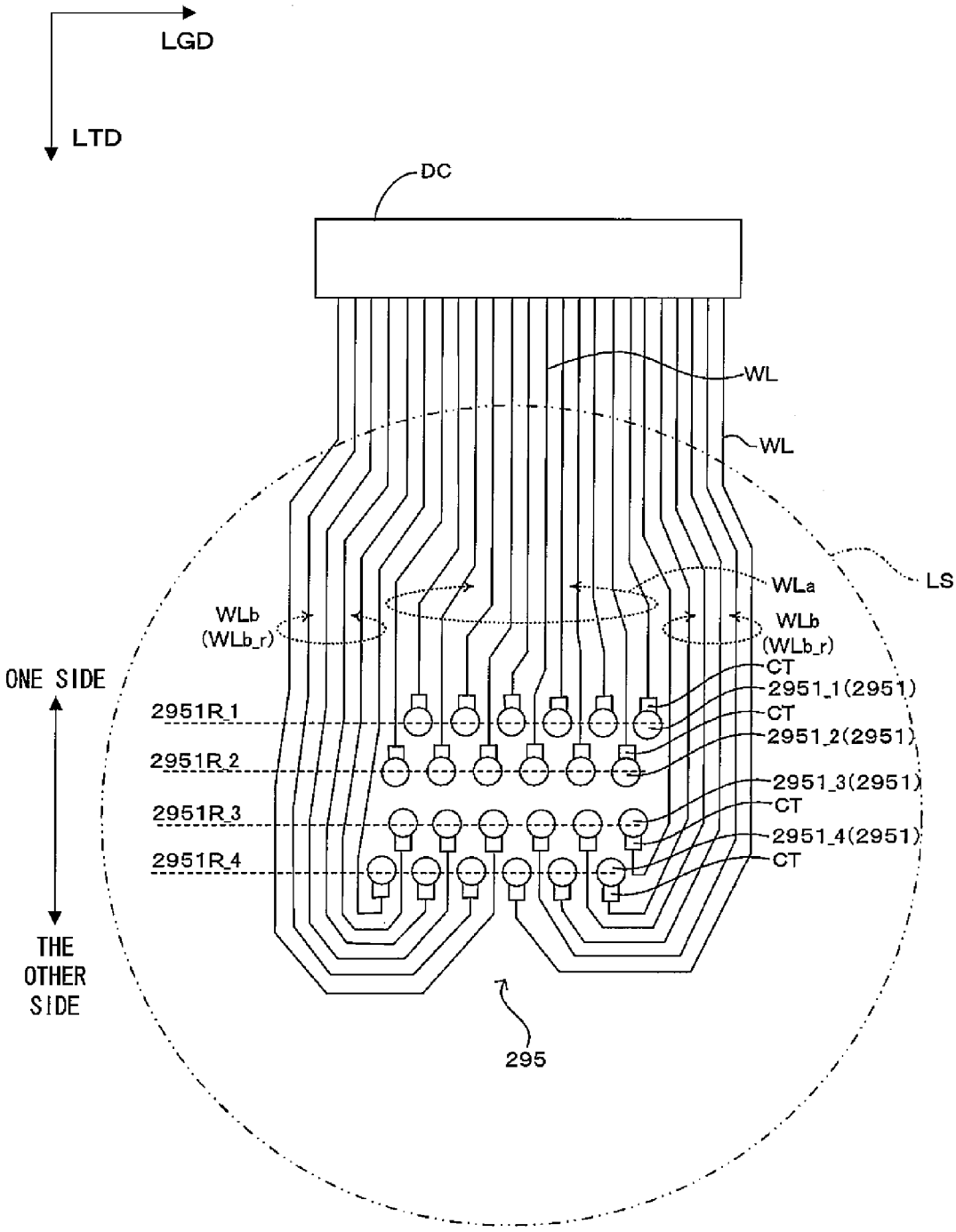

Next, the modification shown in FIG. 23 is described. A characteristic part of the modification shown in FIG. 23 lies in contacts CT provided on light emitting elements 2951 and other parts are common to the modification shown in FIG. 22. The characteristic part of the modification shown in FIG. 23 is mainly described below and the parts common to the modification shown in FIG. 22 are not described by being identified by corresponding reference numerals.

The contacts CT are for connecting anode materials such as ITO (indium tin oxide) of organic EL devices and the wirings WL. In this modification, a degree of freedom of the wirings WL is promoted by arranging the contacts CT in proximity to the light emitting elements 2951. Further, in this modification, the following effect is fulfilled by elaborating the arrangement of the contacts CT. Specifically, if the contacts CT are located proximate to the light emitting elements 2951, the contacts CT may influence the application of an organic EL material in the manufacturing process of the light emitting elements 2951. Thus, the organic EL material is likely to be unevenly applied. However, in this modification, the contacts CT for the respective light emitting elements 2951 of N light emitting element rows 2951R_1, 2951R_2 at one side in the width direction LTD are provided at one side of the light emitting elements 2951 in the width direction LTD. Further, the contacts CT for the respective light emitting elements 2951 of N light emitting element rows 2951R_3, 2951R_4 at the other side in the width direction LTD are provided at the other side of the light emitting elements 2951 in the width direction LTD. Thus, application conditions of the organic EL material are relatively easily controlled. As a result, it becomes possible to form good light emitting elements 2951 by suppressing the uneven application of the organic EL material.

Figure 24:
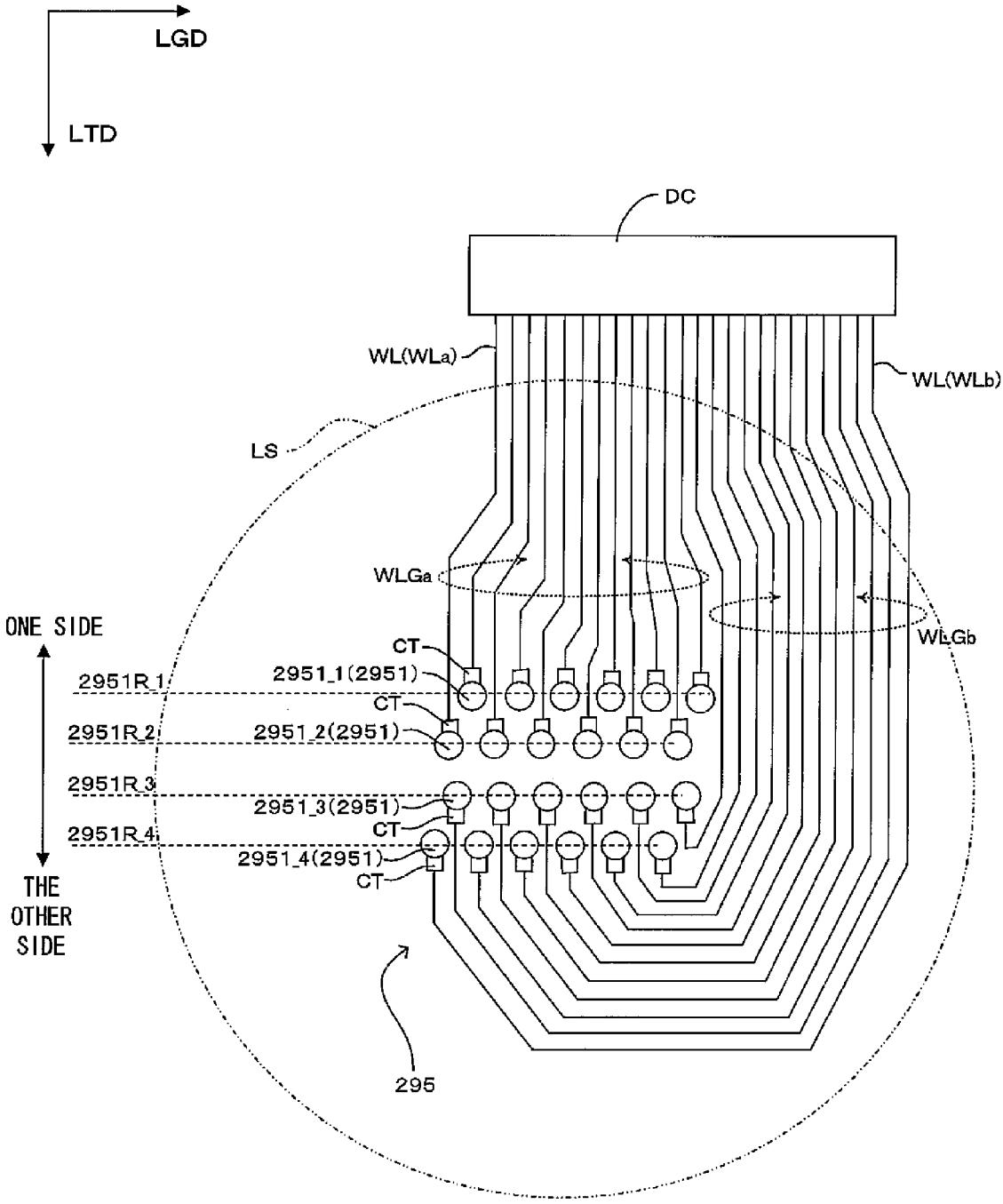

Next, the modification shown in FIG. 24 is described. A characteristic part of the modification shown in FIG. 24 lies in the arrangement mode of wirings WL. The arrangement mode of light emitting elements 2951 and that of a driving circuit DC are similar to those shown in FIGS. 22 and 23. Accordingly, the characteristic part of the modification shown in FIG. 24 is mainly described below and parts common to the modifications shown in FIGS. 22, 23 are not described by being identified by corresponding reference numerals.

The wirings WL connecting the light emitting elements 2951 and the driving circuit DC are arranged as follows.

Specifically, the respective wirings WLa connected with one half of four (namely, two) light emitting element rows 2951R at one side in the width direction LTD, that is, the light emitting element rows 2951R_1, 2951R_2, are drawn toward the one side in the width direction LTD and connected with the driving circuit DC. Further, the respective wirings WLb connected with the other half (namely, two) at the other side in the width direction LTD, that is, the light emitting element rows 2951R_3, 2951R_4, are also drawn toward the one side in the width direction LTD. However, these wirings WLb are drawn while circumventing the light emitting element rows 2951R_1, 2951R_2 and the respective wirings WLa toward the right side. The respective wirings WLb drawn in this way are connected with the driving circuit DC.

Thus, in this modification as well, the wirings WLa connected with the respective light emitting elements 2951 of the N light emitting element rows 2951R_1, 2951R_2 at the one side in the width direction LTD do not pass between the respective light emitting elements 2951 of the N light emitting element rows 2951R_3, 2951R_4 at the other side in the width direction LTD. Similarly, the wirings WLb connected with the respective light emitting elements 2951 of the N light emitting element rows 2951R_3, 2951R_4 at the other side in the width direction LTD do not pass between the respective light emitting elements 2951 of the N light emitting element rows 2951R_1, 2951R_2 at the one side in the width direction LTD. In this way, the number of the wirings passing between the light emitting elements 2951 can be suppressed and the light emitting elements 2951 can be relatively easily enlarged. As a result, a latent image can be satisfactorily formed with a sufficient light quantity even at a high resolution.

Figure 25:
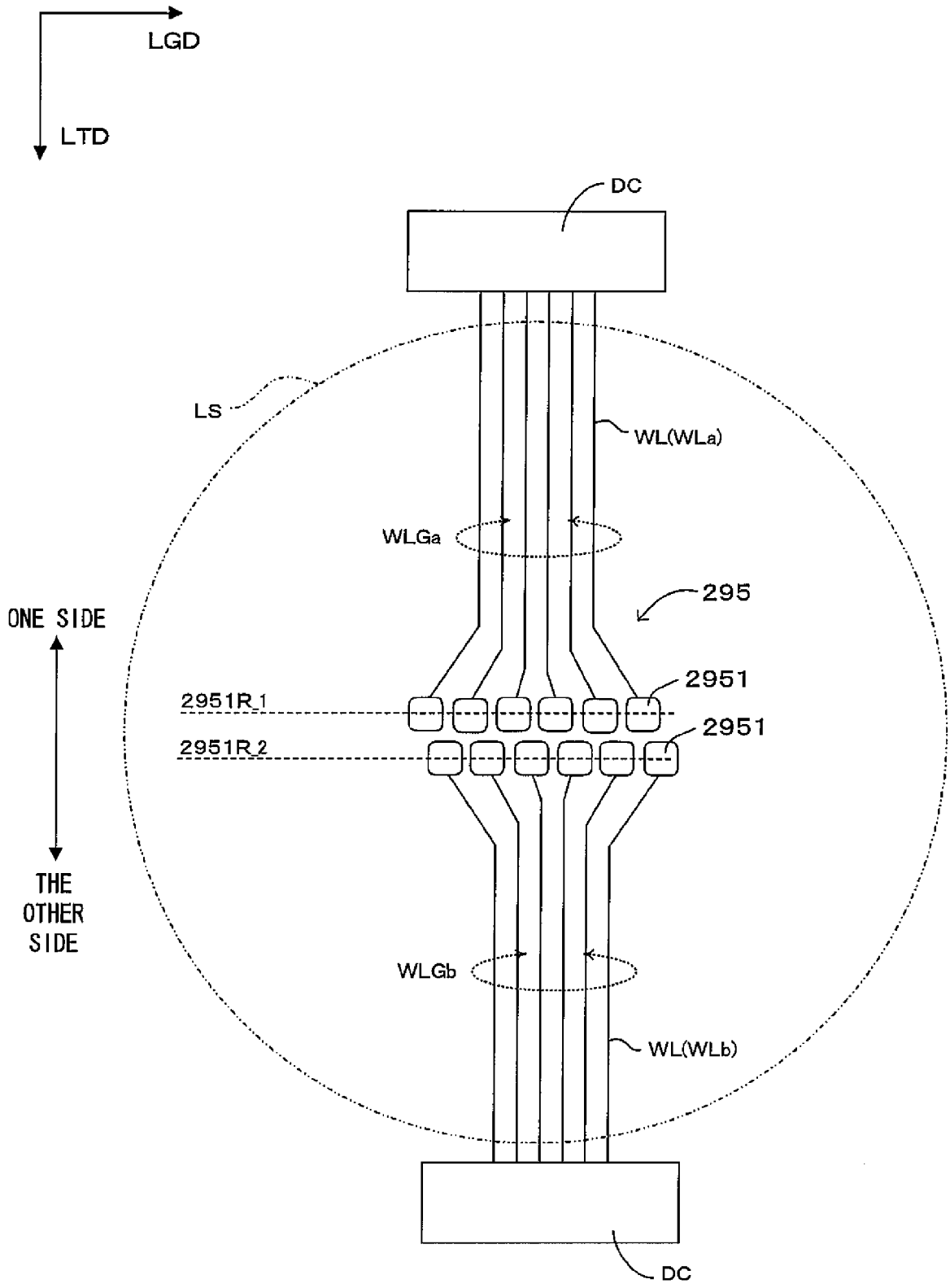

Next, the modification shown in FIG. 25 is described. In this modification, light emitting elements 2951 have a rectangular shape, and two light emitting element rows 2951R_1, 2951R_2 are arranged. Further, a driving circuit DC is provided at each of one and the other sides of a light emitting element group in the width direction LTD. Wirings WL connecting the light emitting elements 2951 and the driving circuits DC are arranged as follows. Specifically, the respective wirings WLa connected with the light emitting element row 2951R_1 at the one side in the width direction LTD out of the two light emitting element rows 2951R are drawn toward the one side in the width direction LTD and connected with the driving circuit DC (first electric circuit) provided at the one side. Further, the respective wirings WLb connected with the light emitting element row 2951R_2 at the other side in the width direction LTD are drawn toward the other side in the width direction LTD and connected with the driving circuit DC (second electric circuit) provided at the other side.

As described above, in this modification as well, the wirings WLa connected with the respective light emitting elements 2951 of the N (N=1 in this modification) light emitting element row 2951R_1 at the one side in the width direction LTD do not pass between the respective light emitting elements 2951 of the N light emitting element rows 2951R_2 at the other side in the width direction LTD. Similarly, the wirings WLb connected with the respective light emitting elements 2951 of the N light emitting element row 2951R_2 at the other side in the width direction LTD do not pass between the respective light emitting elements 2951 of the N light emitting element row 2951R_1 at the one side in the width direction LTD. In this way, the number of the wirings passing between the light emitting elements 2951 can be suppressed and the light emitting elements 2951 can be relatively easily enlarged. As a result, a latent image can be satisfactorily formed with a sufficient light quantity even at a high resolution.

Figure 26:
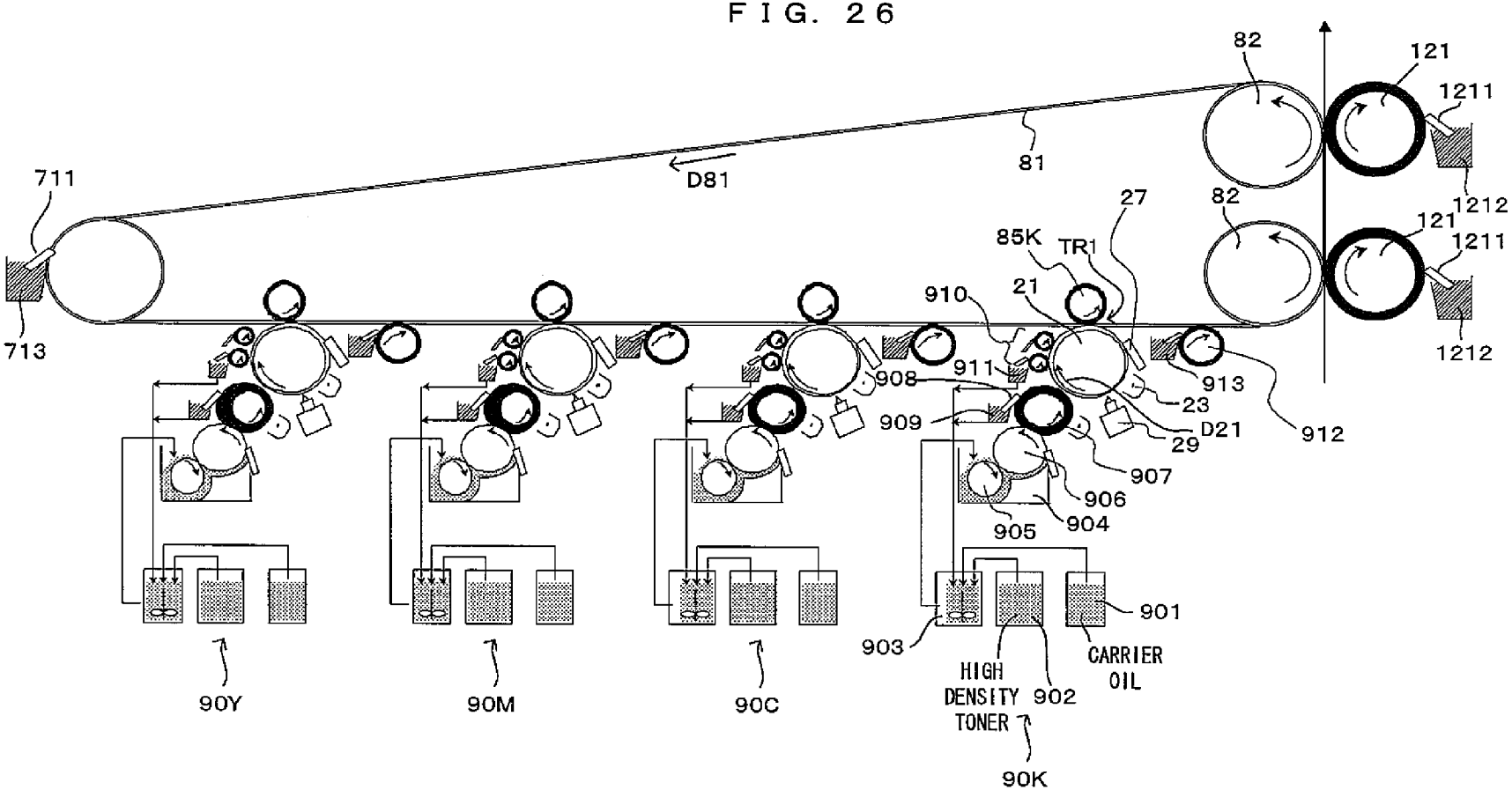
FIG. 26 is a diagram schematically showing an apparatus for developing an image by a liquid developer.

Although an image is formed by developing a latent image by so-called dry toner in the above embodiment, the latent image may be developed by a liquid developer FIG. 26 is a diagram schematically showing an apparatus for developing an image by a liquid developer. Since a difference between the apparatus of FIG. 26 and that of FIG. 3 mainly lies in the construction of a developing unit, the developing unit is mainly described below and other parts are not described by being identified by corresponding reference numerals.

Four developing units 90Y (for yellow), 90M (for magenta), 90C (for cyan) and 90K (for black) corresponding to toner colors are arranged in a conveying direction of an intermediate transfer belt 81. In each of the developing units 90K, etc., an oil container 901 for containing carrier oil, a toner container 902 for containing high density toner and an agitator 903 are provided. In the agitator 903, the carrier oil supplied from the oil container 901 and the high density toner supplied from the toner container 902 are agitated to produce a liquid developer having its density adjusted. The thus produced liquid developer is supplied to a developer container 904. A supply roller 905 and an anilox roller 906 are provided in the developer container 904. A lower part of the supply roller 905 is immersed in the liquid developer in the developer container 904. This supply roller 905 rotates in a direction of arrow in FIG. 26 to scoop the liquid developer up and convey it to the anilox roller 906. The anilox roller 906 rotates in a direction of arrow in FIG. 26 to apply the liquid developer conveyed from the supply roller 905 to a developing roller 907.

The developing roller 107 is in contact with a photosensitive drum 21 at a development position. This developing roller 107 is rotatable in a direction of arrow in FIG. 26, and the liquid developer supplied from the anilox roller 906 is carried on the surface of the developing roller 907 and supplied to the development position. The toner contained in the liquid developer thus supplied adheres to a latent image on the photosensitive drum surface, thereby performing a developing operation.

A cleaner blade 908 is in contact with the developing roller 907 downstream of the development position in the rotating direction of the developing roller 907. The liquid developer is scarped off from the surface of the developing roller 907 by this cleaner blade 908 and collected into a collection container 909. The liquid developer collected into this collection container 909 is returned to the agitator 903 for reuse.

Two photosensitive drum squeeze rollers 910 are arranged in contact with the surface of the photosensitive drum 21 downstream of the development position in a rotating direction D21 of the photosensitive drum. The photosensitive drum squeeze rollers 910 remove the carrier oil from the surface of the photosensitive drum 21, whereby the amount of the carrier oil contained in the liquid developer on the surface of the photosensitive drum 21 is adjusted. Further, the removed carrier oil is returned to the agitator 903 for reuse after being collected into a collection container 911.

An image obtained by developing a latent image at the development position is transferred to the intermediate transfer belt 81 at a primary transfer position TR1. A belt squeeze roller 912 is in contact downstream of the primary transfer position TR1 in a conveying direction D81 of the intermediate transfer belt 81. This belt squeeze roller 912 removes the carrier oil from the surface of the intermediate transfer belt 81, whereby the amount of the carrier oil contained in the liquid developer on the surface of the intermediate transfer belt 81 is adjusted. Further, the removed carrier oil is collected into a collection container 913.

The image primarily transferred in this way is secondarily transferred to a sheet. This secondary transfer operation is performed by two secondary transfer rollers 82 and backup rollers 121 arranged to face the respective secondary transfer rollers 82. Further, cleaner blades 1211 are held in contact with the respective backup rollers 121, so that the liquid developer remaining on the backup rollers 121 is removed by the cleaner blades 1211 and collected into collection containers 1212.

As described above, in the apparatus of FIG. 26, a latent image is developed by the liquid developer (liquid development). Generally, such a liquid developer can develop an image with relatively high accuracy. Thus, spot latent images satisfactorily formed by the above invention are preferably developed by the liquid development.

Although both the main-scanning resolution and the sub-scanning resolution are 600 dpi in the above embodiments, the respective resolutions are not limited to 600 dpi. Particularly, concerning the sub-scanning resolution, a resolution of 600 dpi or higher can be relatively easily realized by segmenting the emission times of the light emitting elements 2951 through a pulse width modulation control. Accordingly, the sub-scanning resolution may be increased, for example, to 2400 dpi while setting the main-scanning resolution to 600 dpi. At this time, the sub-scanning pixel pitch Rsd is one fourth of the main-scanning pixel pitch Rmd since the sub-scanning resolution is four times as high as the main-scanning resolution.

Although the light emitting element group column 295C is made up of three light emitting element groups 295 in the above embodiments, the number of the light emitting element groups 295 constituting the light emitting element group column 295C is not limited to this.

In this invention, the imaging magnification (lateral magnification) of the lens array 299 can be arbitrarily set. If the lens array 299 is a magnifying optical system with a high imaging magnification, intervals between the light emitting elements are smaller than intervals between spots focused on the surface of the photosensitive drum 21. Likewise, the diameter of light emitting parts of the light emitting elements is also smaller. However, since width necessary for the wirings is constant, it is more difficult to pass the wirings between the light emitting elements as shown in FIG. 18. Thus, if the lens array 299 is a magnifying optical system, it is useful to arrange light emitting elements in an even number of rows as in this invention.

As described above, an embodiment of an exposure head according to the invention comprises: imaging optical systems which are arranged in a first direction; light emitting elements which are arranged in a second direction orthogonal to or substantially orthogonal to the first direction and emit lights to be imaged by the imaging optical systems; a first wiring which is connected with the light emitting element located at a first side in the second direction; and a second wiring which is connected with the light emitting element located at a second side in the second direction.

Further, an embodiment of an image forming apparatus according to the invention comprises: an exposure head which includes imaging optical systems which are arranged in a first direction, light emitting elements which are arranged in a second direction orthogonal to or substantially orthogonal to the first direction and emit lights to be imaged by the imaging optical systems, a first wiring which is connected with the light emitting element located at a first side in the second direction, and a second wiring which is connected with the light emitting element located at a second side in the second direction; and a latent image carrier which carries a latent image formed by the exposure head.

Further, an embodiment of an image forming method according to the invention comprises: forming a latent image on a latent image carrier by an exposure head which includes imaging optical systems which are arranged in a first direction, light emitting elements which are arranged in a second direction orthogonal to or substantially orthogonal to the first direction and emit lights to be imaged by the imaging optical systems, a first wiring which is connected with the light emitting element located at a first side in the second direction, and a second wiring which is connected with the light emitting element located at a second side in the second direction.

In the thus constructed embodiment (exposure head, image forming apparatus, image forming method), lights from the light emitting elements are imaged by the imaging optical systems. These light emitting elements are not linearly arranged as in the related art, but are arranged at the positions different in the second direction. By arranging the light emitting elements in this way, the light emitting elements can be formed in relatively larger spaces, wherefore they can be enlarged. Further, this embodiment includes a first wiring which is connected with the light emitting element located at a first side in the second direction and a second wiring which is connected with the light emitting element located at a second side in the second direction, and hence, this embodiment is advantageous in suppressing the number of the wirings passing between the light emitting elements. Accordingly, the light emitting element can be enlarged relatively easily. Thus, the embodiment has a construction capable of relatively easily enlarging the light emitting elements, with the result that a latent image can be satisfactorily formed with a sufficient light quantity even at a high resolution.

The exposure head may be constructed such that the first wiring is so arranged as not to pass between the light emitting elements located at the second side, and the second wiring is so arranged as not to pass between the light emitting elements located at the first side. This is because the light emitting elements can be enlarged by suppressing the number of the wirings passing between the light emitting elements, wherefore a latent image can be satisfactorily formed with a sufficient light quantity even at a high resolution.

Further, the exposure head may be constructed such that the first wiring is drawn toward the first side, and the second wiring is drawn toward the second side. In this case, the exposure head may be constructed such that it comprises: a first electric circuit which is arranged at the first side and with which the first wiring is connected; and a second electric circuit which is arranged at the second side and with which the second wiring is connected. Since the light emitting elements can be enlarged by suppressing the number of the wirings passing between the light emitting elements in these constructions as well, a latent image can be satisfactorily formed with a sufficient light quantity even at a high resolution.

The first wiring may be drawn toward the first side, and the second wiring may be drawn toward the second side while circumventing the light emitting element located at the first side and the first wiring. In this case, an electric circuit which is arranged at the first side and with which the first and the second wirings are connected may be provided. Since the light emitting elements can be enlarged by suppressing the number of the wirings passing between the light emitting elements in these constructions as well, a latent image can be satisfactorily formed with a sufficient light quantity even at a high resolution.

The electrical circuit may be a driving circuit for driving the light emitting elements. In such a construction, the driving circuit can be provided in proximity to the light emitting elements and signals with less dampening due to the stray capacitances of the wirings can be supplied to the light emitting elements, which is advantageous to a good latent image forming operation.

The exposure head may be constructed such that a width of the light emitting element in the first direction is larger than a distance between the light emitting elements in the first direction. This is because a satisfactory latent image forming operation is possible with a sufficient light quantity by using the light emitting elements having such a size.

Organic EL devices can be used as the light emitting elements, but they have a relatively small light quantity. Accordingly, for a construction using organic EL devices, it is preferable to apply the embodiment enabling the light emitting elements to be enlarged.

Bottom emission-type organic EL devices have a particularly small light quantity. Accordingly, for a construction using bottom emission-type organic EL devices, it is preferable to apply the embodiment enabling the light emitting elements to be enlarged.

Further, the image forming apparatus may also be constructed such that the exposure head images lights from the light emitting elements by means of the imaging optical systems to form a focused portion on the latent image carrier and 2N (N is an integer) light emitting elements are driven to emit lights in conformity with a movement of the latent image carrier in the second direction to from 2N focused portions aligned in the first direction. In this case, a distance between the focused portions in the second direction is preferably set to an integral multiple of a distance between pixels in the second direction. As described earlier, in such a construction, the focused portions can be properly formed on the respective pixels by driving the respective light emitting elements to emit lights at the same timing. Therefore, an emission timing control of the respective light emitting elements can be simplified.

An embodiment of an exposure head according to another aspect of the invention comprises a substrate including a plurality of light emitting elements grouped into light emitting element groups, and a lens array in which lenses for imaging light beams emitted from the light emitting elements of the light emitting element groups as spots to form spot latent images on an image plane are provided in a one-to-one correspondence with the light emitting element groups. The image plane moves in a second direction orthogonal to or substantially orthogonal to a first direction. The respective light emitting elements are driven to emit lights at timings corresponding to a movement of the image plane, whereby a plurality of spot latent images are formed side by side in the first direction. An even number of light emitting element rows each including a plurality of light emitting elements aligned in a direction corresponding to the first direction are arranged in a direction corresponding to the second direction in each light emitting element group. And, the respective light emitting element rows are displaced from each other in the direction corresponding to the first direction such that two light emitting elements for forming the spot latent images adjacent in the first direction belong to different light emitting element rows.

Further, an embodiment of an image forming apparatus according to another aspect of the invention comprises a latent image carrier whose surface moves in a direction orthogonal to or substantially orthogonal to a first direction, and an exposure head which forms spot latent images on the surface of the latent image carrier. The exposure head includes a substrate including a plurality of light emitting elements grouped into light emitting element groups, and a lens array in which lenses for imaging light beams emitted from the light emitting elements of the light emitting element groups as spots to form spot latent images on the surface of the latent image carrier are provided in a one-to-one correspondence with the light emitting element groups. The respective light emitting elements are driven to emit lights at timings in conformity with a movement of the latent image carrier surface to form a plurality of spot latent images side by side in the first direction. An even number of light emitting element rows each including a plurality of light emitting elements aligned in a direction corresponding to the first direction are arranged in a direction corresponding to the second direction in each light emitting element group And, the respective light emitting element rows are displaced from each other in the direction corresponding to the first direction such that two light emitting elements for forming spot latent images adjacent in the first direction belong to different light emitting element rows.

In the thus constructed embodiment (exposure head, image forming apparatus), the plurality of light emitting elements are arranged while being grouped into the light emitting element groups. In each light emitting element group, the light emitting element rows each including the plurality of light emitting elements aligned in the direction corresponding to the first direction are arranged in the direction corresponding to the second direction. Further, the respective light emitting elements are displaced from each other in the direction corresponding to the first direction in each light emitting element group such that two light emitting elements for forming spot latent images adjacent in the first direction belong to different light emitting element rows. In other words, in this embodiment, two light emitting elements for forming spot latent images adjacent in the first direction are displaced from each other in the direction corresponding to the first direction. Thus, the light emitting elements can be formed in relatively larger spaces, wherefore they can be enlarged. Therefore, spot latent images can be formed with sufficient light quantities even at a high resolution and the formation of good spot latent images is possible.

Further, in this embodiment, the even number of light emitting element rows are arranged in each light emitting element group. Accordingly, it is possible to divide these light emitting element rows into the light emitting element row(s) on one half in the direction corresponding to the second direction and the light emitting element row(s) on the other half and to arrange wirings for the respective light emitting element rows. As a result, as described earlier, the number of wirings passing between the light emitting elements can be reduced and this construction is advantageous in enlarging the light emitting elements.

Further, one wiring group extending toward one side of the light emitting element group in the direction corresponding to the second direction and another wiring group extending toward the other side may be provided, the respective wirings of the one wiring group may be connected with the respective light emitting elements of the light emitting element row(s) on the one half of the even number of light emitting element rows of the light emitting element group and the respective wirings of the other wiring group may be connected with the respective light emitting elements of the light emitting element row(s) on the other half of the even number of light emitting element rows of the light emitting element group.

In such a construction, the respective wirings of the one wiring group are connected with the respective light emitting elements of the light emitting element row(s) on the one half of the even number of light emitting element rows of the light emitting element group and the respective wirings of the other wiring group are connected with the respective light emitting elements of the light emitting element row(s) on the other half. Further, the one wiring group extends toward the one side of the light emitting element group and the other wiring group extends toward the other side of the light emitting element group. In other words, the one and the other wiring groups extend in directions opposite to each other. Therefore, the respective wiring groups can have similar configurations to facilitate a wiring arrangement.

Organic EL devices can be used as the light emitting elements, but they have a relatively small light quantity. Accordingly, for a construction using organic EL devices, it is preferable to apply the embodiment enabling the light emitting elements to be enlarged.

When a pitch in the direction corresponding to the first direction between two light emitting elements for forming spot latent images adjacent in the first direction is a light emitting element pitch, a diameter of the light emitting elements in the direction corresponding to the first direction may be larger than the light emitting element pitch. This is because the formation of good spot latent images is possible by using the light emitting elements having such a size.

The light emitting element rows may be arranged such that a pitch in the second direction between an even number of spot rows formed on the image plane by simultaneously driving the light emitting element groups to emit lights is an integral multiple of a pixel pitch in the second direction. In the case of such a construction, spot latent images can be properly formed on the respective pixels by driving the respective light emitting element rows to emit lights at the same timing. Therefore, an emission timing control of the respective light emitting elements can be simplified.

In the image forming apparatus using the above construction capable of satisfactorily forming spot latent images, the spot latent images may be developed by a liquid developer. In other words, the liquid developer can develop latent images with relatively high accuracy. Therefore, it is preferable to develop spot latent images satisfactorily formed by the above embodiment by the liquid developer.

Although the invention has been described with reference to specific embodiments, this description is not meant to be construed in a limiting sense. Various modifications of the disclosed embodiment, as well as other embodiments of the invention, will become apparent to persons skilled in the art upon reference to the description of the invention. It is therefore contemplated that the appended claims will cover any such modifications or embodiments as fall within the true scope of the invention.

What is claimed is:

1. An exposure head, comprising:

imaging optical systems which are arranged in a first direction;

light emitting elements which are arranged in a second direction orthogonal to the first direction and emit lights to be imaged by the imaging optical systems;

a first wiring which is connected with the light emitting element located at a first side in the second direction; and a second wiring which is connected with the light emitting element located at a second side in the second direction.

2. The exposure head according to claim 1, wherein the first wiring is so arranged as not to pass between the light emitting elements located at the second side, and the second wiring is so arranged as not to pass between the light emitting elements located at the first side.

3. The exposure head according to claim 2, wherein the first wiring is drawn toward the first side, and the second wiring is drawn toward the second side.

4. The exposure head according to claim 3, comprising:

a first electric circuit which is arranged at the first side and with which the first wiring is connected; and a second electric circuit which is arranged at the second side and with which the second wiring is connected.

5. The exposure head according to claim 4, wherein the first and the second electric circuits are driving circuits which drive the light emitting elements.

6. The exposure head according to claim 2, wherein the first wiring is drawn toward the first side, and the second wiring is drawn toward the second side while circumventing the light emitting element located at the first side and the first wiring.

7. The exposure head according to claim 6, comprising an electric circuit which is arranged at the first side and with which the first and the second wirings are connected.

8. The exposure head according to claim 7, wherein the electric circuit is a driving circuit which drives the light emitting elements.

9. The exposure head according to claim 1, wherein a width of the light emitting element in the first direction is larger than a distance between the light emitting elements in the first direction.

10. The exposure head according to claim 1, wherein the light emitting elements are organic EL devices.

11. The exposure head according to claim 10, wherein the organic EL devices are bottom emission-type organic EL devices.

12. An image forming apparatus, comprising:

an exposure head which includes imaging optical systems which are arranged in a first direction, light emitting elements which are arranged in a second direction orthogonal to the first direction and emit lights to be imaged by the imaging optical systems, a first wiring which is connected with the light emitting element located at a first side in the second direction, and a second wiring which is connected with the light emitting element located at a second side in the second direction; and a latent image carrier which carries a latent image formed by the exposure head.

13. An image forming method, comprising:

forming a latent image on a latent image carrier by an exposure head which includes imaging optical systems which are arranged in a first direction, light emitting elements which are arranged in a second direction orthogonal to the first direction and emit lights to be imaged by the imaging optical systems, a first wiring which is connected with the light emitting element located at a first side in the second direction, and a second wiring which is connected with the light emitting element located at a second side in the second direction.

14. The image forming method according to claim 13, wherein in the forming the latent image on the latent image carrier, moving the latent image carrier in the second direction, and forming a focused portion on the latent image carrier by imaging the lights from the light emitting elements by means of the imaging optical systems, and wherein in the forming the focused portion, driving 2N (N is an integer) light emitting elements to emit lights in conformity with the movement of the latent image carrier in the second direction to form 2N focused portions aligned in the first direction.

15. The image forming method according to claim 14, wherein a distance between the focused portions in the second direction is an integer multiple of a distance between pixels in the second direction.

* * * * *